US007424766B2

(12) United States Patent
Reindle et al.

(10) Patent No.: US 7,424,766 B2
(45) Date of Patent: Sep. 16, 2008

(54) SENSORS AND ASSOCIATED METHODS FOR CONTROLLING A VACUUM CLEANER

(75) Inventors: Mark E. Reindle, Sagamore Hills, OH (US); Norman Siegel, Mentor, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 633 days.

(21) Appl. No.: 11/209,992

(22) Filed: Aug. 23, 2005

(65) Prior Publication Data

US 2005/0278888 A1 Dec. 22, 2005

Related U.S. Application Data

(63) Continuation-in-part of application No. 10/665,709, filed on Sep. 19, 2003, now Pat. No. 7,237,298.

(51) Int. Cl.
*A47L 9/28* (2006.01)
*A47L 9/04* (2006.01)
*A47L 5/00* (2006.01)

(52) U.S. Cl. ..... 15/319; 15/377; 15/383; 15/340.1; 15/340.3

(58) Field of Classification Search ..... 15/319, 15/339, 340.1, 340.3, 377, 383
See application file for complete search history.

(56) References Cited

U.S. PATENT DOCUMENTS 4,558,215 A 12/1985 Kaneko et al.
5,109,566 A 5/1992 Kobayashi et al.
5,279,672 A 1/1994 Betker et al.
5,321,614 A 6/1994 Ashworth
5,341,540 A 8/1994 Soupert et al.
5,377,106 A 12/1994 Drunk et al.
5,542,146 A 8/1996 Hoekstra et al.
5,613,261 A 3/1997 Kawakami et al.
5,634,237 A 6/1997 Paranjpe
5,940,927 A 8/1999 Haegermarck et al.

(Continued)

FOREIGN PATENT DOCUMENTS

EP 1149332 B1 8/2003
WO WO 00/38027 6/2000
WO WO 2005/077240 8/2005

OTHER PUBLICATIONS

Home Appliances, Vacuum Cleaners, SG2039/D, Rev 0, Apr. 2003, Motorola, Inc. (6 pages).

(Continued)

*Primary Examiner*—David B Thomas
(74) *Attorney, Agent, or Firm*—Fay Sharpe, LLP

(57) ABSTRACT

A cleaning appliance includes a housing with a brushroll and a wheel mounted thereto. A floor-type sensor is disposed within a mounting tube secured to the housing. The floor-type sensor emits sonic energy toward a surface being traversed by the cleaning appliance and receives corresponding sonic energy reflected by the surface. A comparator, electrically coupled to the floor-type sensor, compares the received reflected sonic energy to one or more associated predetermined values to determine the type of surface being traversed. A processor analyzes the results of the comparison and controls at least one of a suction fan, said wheel and said brushroll, based at least in part on the analysis.

24 Claims, 16 Drawing Sheets

U.S. PATENT DOCUMENTS

| | | | |
|---|---|---|---|
| 6,076,227 | A | 6/2000 | Eyerer et al. |
| 6,493,612 | B1 | 12/2002 | Bisset et al. |
| 6,571,415 | B2 | 6/2003 | Gerber et al. |
| 6,571,422 | B1 | 6/2003 | Frigo et al. |
| 6,590,222 | B1 | 7/2003 | Bisset et al. |
| 6,594,844 | B2 | 7/2003 | Jones |
| 6,671,592 | B1 | 12/2003 | Bisset et al. |

OTHER PUBLICATIONS

The New York Times, www.nytimes.com, "It Mulches, Too? Robotic Mowers Gain in Appeal" by John R. Quain, Jul. 21, 2003 (3 pages).

H.R. Everett, Sensors for Mobile Robots, Theory and Application, Naval Command, Control and Ocean Surveillance Center, San Diego, California, A.K. Peters, Ltd. 1995, pp. 15-17 and 93-101.

Joseph L. Jones et al., Mobile Robots, Inspiration to Implementation, Second Edition, A.K. Peters, Ltd. 1999, pp. 120-134.

SENSORS AND ASSOCIATED METHODS FOR CONTROLLING A VACUUM CLEANER

CROSS-REFERENCE TO RELATED PATENTS AND APPLICATIONS

This application is a Continuation-In-Part of U.S. utility patent application Ser. No. 10/665,709 filed on Sep. 19, 2003 now U.S. Pat. No. 7,237,298 and entitled "SENSORS AND ASSOCIATED METHODS FOR CONTROLLING A VACUUM CLEANER," the entirety of which is incorporated herein by reference.

BACKGROUND OF INVENTION

The invention relates to methods of controlling a vacuum cleaner using various types of sensors. It finds particular application in conjunction with upright vacuum cleaners as well as robotic vacuum cleaners. A suitable robotic vacuum cleaner includes, but is not limited to, a controller, a cleaning head, and an interconnecting hose assembly, and the invention will be described with particular reference thereto. However, it is to be appreciated that the invention is also amenable to other applications. For example, a traditional upright vacuum cleaner, a traditional canister vacuum cleaner, a carpet extractor, other types of vacuum cleaners, and other types of robotic vacuums. More generally, this invention is amenable to various types of robotic and/or manual household appliances, both indoor, such as floor polishers, and outdoor, such as lawnmowers or window washing robots.

It is well known that robots and robot technology can automate routine household tasks eliminating the need for humans to perform these repetitive and time-consuming tasks. Currently, technology and innovation are both limiting factors in the capability of household cleaning robots. Computer processing power, battery life, electronic sensors such as cameras, and efficient electric motors are all either just becoming available, cost effective, or reliable enough to use in autonomous consumer robots.

Generally, there are two standard types of vacuums: upright and canister. Uprights tend to be more popular because they are smaller, easier to manipulate and less expensive to manufacture. Conversely, the principal advantage of canister vacuums is that, while the canister may be more cumbersome, the cleaning head is smaller. A few patents and published patent applications have disclosed self-propelled and autonomous canister-like vacuum cleaners.

Much of the work on robotic vacuum technology has centered on navigation and obstacle detection and avoidance. The path of a robot determines its success at cleaning an entire floor and dictates whether or not it will get stuck. Some proposed systems have two sets of orthogonal drive wheels to enable the robot to move directly between any two points to increase its maneuverability. Robotic vacuum cleaners have mounted the suction mechanisms on a pivoting or transverse sliding arm so as to increase the reach of the robot. Many robotic vacuums include methods for detecting and avoiding obstacles.

Thus, there is a need for an improved vacuum cleaner, the improvements of which apply to various types of vacuum cleaners, as well as other household appliances, both indoor and outside.

BRIEF SUMMARY OF INVENTION

The invention contemplates a canister and upright vacuum cleaner, as well as other types of cleaning appliance.

In one aspect of the invention, a cleaning appliance includes a housing with a brushroll and a wheel mounted thereto. A floor-type sensor is disposed within a mounting tube secured to the housing. The floor-type sensor emits sonic energy toward a surface being traversed by the cleaning appliance and receives corresponding sonic energy reflected by the surface. A comparator, electrically coupled to the floor-type sensor, compares the received reflected sonic energy to one or more associated predetermined values to determine the type of surface being traversed. A processor analyzes the results of the comparison and controls at least one of a suction fan, said wheel and said brushroll, based at least in part on the analysis.

In another aspect of the invention, a vacuum cleaner has a housing that includes: a suction opening located in a bottom wall of the housing; a brushroll mounted to the housing and located in the suction opening; a wheel mounted to the housing for supporting the housing on a subjacent surface; and a mounting tube secured to the housing, wherein the mounting tube includes a first end, opening to the housing bottom wall; and a second end. A floor type sensor is disposed adjacent to the mounting tube second end and emits sonic energy toward the subjacent surface and receives corresponding sonic energy reflected by the surface. A comparator, electrically coupled to the sensor, compares the received reflected sonic energy to one or more associated predetermined values to determine the type of surface being traversed. A processor analyzes the results of the comparison and controls at least one of a suction fan, the wheel and the brushroll, based at least in part on the analysis.

In still another aspect of the invention, a vacuum cleaner includes a floor nozzle with a suction opening communicating with a suction source; a brushroll; a first motor for driving said brushroll; at least one wheel on which said floor nozzle is mounted to allow the floor nozzle to move in relation to a subjacent surface; a second motor for driving said at least one wheel; and a mounting tube including a first end, opening toward the subjacent surface, and a second end. A sonic sensor disposed adjacent to the mounting tube second end emits sonic energy toward the subjacent surface and receives corresponding sonic energy reflected by the surface. A comparator, electrically coupled to the sensor, compares the received reflected sonic energy to one or more associated predetermined values to determine the type of surface being traversed. A processor analyzes the results of the comparison and controls at least one of the suction source, the first motor, and the second motor.

Benefits and advantages of the invention will become apparent to those of ordinary skill in the art upon reading and understanding the description of the invention provided herein.

BRIEF DESCRIPTION OF DRAWINGS

The invention is described in more detail in conjunction with a set of accompanying drawings, wherein.

DETAILED DESCRIPTION

Figure 1:
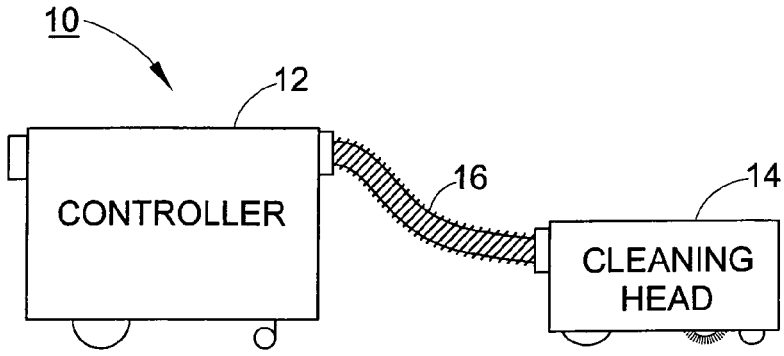
FIG. 1 is a functional block diagram of an embodiment of a robotic canister-like vacuum cleaner according to the present invention.

While the invention is described in conjunction with the accompanying drawings, the drawings are for purposes of illustrating exemplary embodiments of the invention and are not to be construed as limiting the invention to such embodiments. It is understood that the invention may take form in various components and arrangement of components and in various steps and arrangement of steps beyond those provided in the drawings and associated description. Within the drawings, like reference numerals denote like elements. It is to be appreciated that the invention is amenable to various applications. For example, a traditional upright vacuum cleaner, a traditional canister vacuum cleaner, a carpet extractor, other types of vacuum cleaners, and other types of robotic vacuums. More generally, this invention is amenable to various types of household appliances, both indoor, such as floor polishers, and outdoor, such as lawnmowers or window washing robots.

With reference to FIG. 1, an embodiment of a robotic vacuum 10 includes a controller 12, a cleaning head 14 and a hose 16. The robotic vacuum 10 somewhat resembles conventional canister vacuum cleaners and may be referred to herein as a robotic canister-like vacuum, for the sake of convenience.

The controller 12 is in fluidic communication with the cleaning head 14 via a hose 16 for performing vacuuming functions. The controller is also in operative communication with the cleaning head 14 with respect to control functions. Essentially, in the embodiment being described, the controller 12 and the cleaning head 14 are separate housings and cooperate by moving in tandem across a surface area to vacuum dirt and dust from the surface during robotic operations. Typically, the cleaning head 14 acts as a slave to the controller 12 for robotic operations. Since the cleaning head 14 is separate from the controller 12 in a tandem configuration, the cleaning head 14 can be significantly smaller than the controller 12 and smaller than known one-piece robotic vacuums. The small cleaning head 14 is advantageous because it can access and clean small or tight areas, including under and around furniture.

The controller 12 performs mapping, localization, planning and control for the robotic vacuum 10. Typically, the controller 12 "drives" the robotic vacuum 10 throughout the surface area. While the controller 12 is performing this function, it may also learn and map a floor plan for the surface area including any existing stationary objects. This includes: i) detecting characteristics of the environment, including existing obstacles, using localization sensors, ii) mapping the environment from the detected characteristics and storing an environment map in a controller processor 74 (FIG. 4), iii) determining a route for the robotic vacuum 10 to traverse in order to clean the surface area based on the environment map, and iv) storing the route for future reference during subsequent robotic operations. Thus, the controller 12 provides the robotic vacuum 10 with an automated environment-mapping mode. Automated environment mapping allows the vacuuming function to be performed automatically in future uses based on the mapped environment stored in the controller 12.

Figure 2:
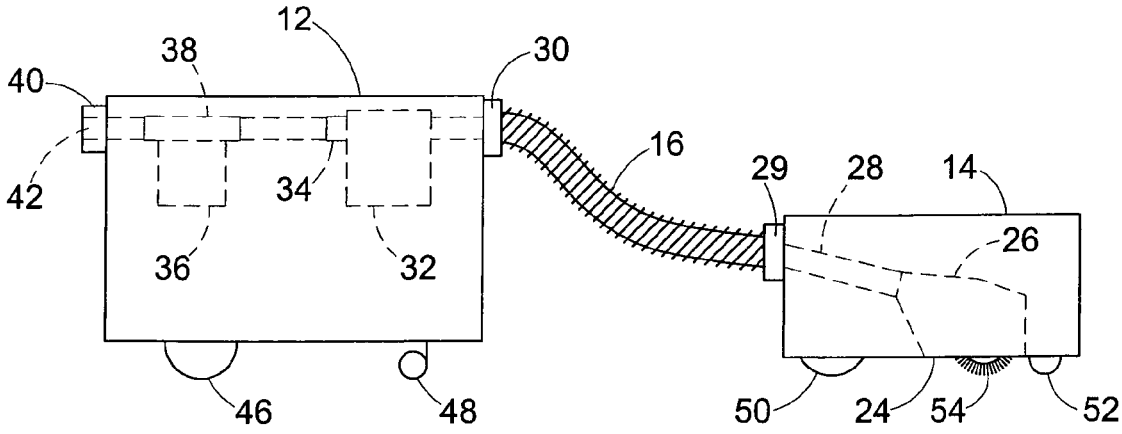
FIG. 2 is a functional block diagram showing a suction airflow path in an embodiment of the robotic canister-like vacuum cleaner of FIG. 1.

With reference to FIG. 2, various functions of the major components of the robotic vacuum 10 are shown, including the suction airflow path associated with vacuuming functions. The cleaning head 14 includes a suction inlet 24, a brush chamber 26, a suction conduit 28 and a cleaning head outlet 29. The controller 12 includes a vacuum inlet 30, a dirt receptacle 32, a primary filter 34, a suction motor 36, a suction fan 38, a vacuum outlet 40 and a secondary filter 42. As is well known, the suction fan 38 is mechanically connected to the suction motor 36. The suction fan 38 creates an airflow path by blowing air through the vacuum outlet 40. Air is drawn into the airflow path at the suction inlet 24. Thus, a suction airflow path is created between the suction inlet 24 and the suction fan 38. The vacuum or lower pressure in the suction airflow path also draws dirt and dust particles in the suction inlet 24. The dirt and dust particles flow through the hose 16 and are retained in the dirt receptacle 32. The dirt receptacle 32 may be dirt cup or a disposable bag, depending on whether a bag-less or bagged configuration is implemented.

Additionally, as shown in FIG. 2, the controller 12 can include at least one wheel 46 and a caster 48. The cleaning head 14 can also include at least one wheel 50, a caster 52 and a rotating brush roll 54, as is known in the art. Typically, the controller 12 and the cleaning head 14 both include two wheels and one or two casters. However, additional wheels, and/or additional casters may be provided. Likewise, tracked wheels can be used in addition to or in place of the wheels and casters. The wheels are driven to provide self-propelled movement. If the wheels (e.g., 46) are independently controlled, they may also provide steering. Otherwise, one or more of the casters (e.g., 48) may be controlled to provide steering. The configuration of wheel and casters in the cleaning head 14 may be the same or different from the configuration in the controller 12. Likewise, movement and steering functions in the cleaning head 14 may be implemented in the same manner as movement and steering functions in the controller 12, or in a different manner. For vacuuming, depending on the floor type, the brush 54 rotates and assists in the collection of dirt and dust particles.

Figure 3:
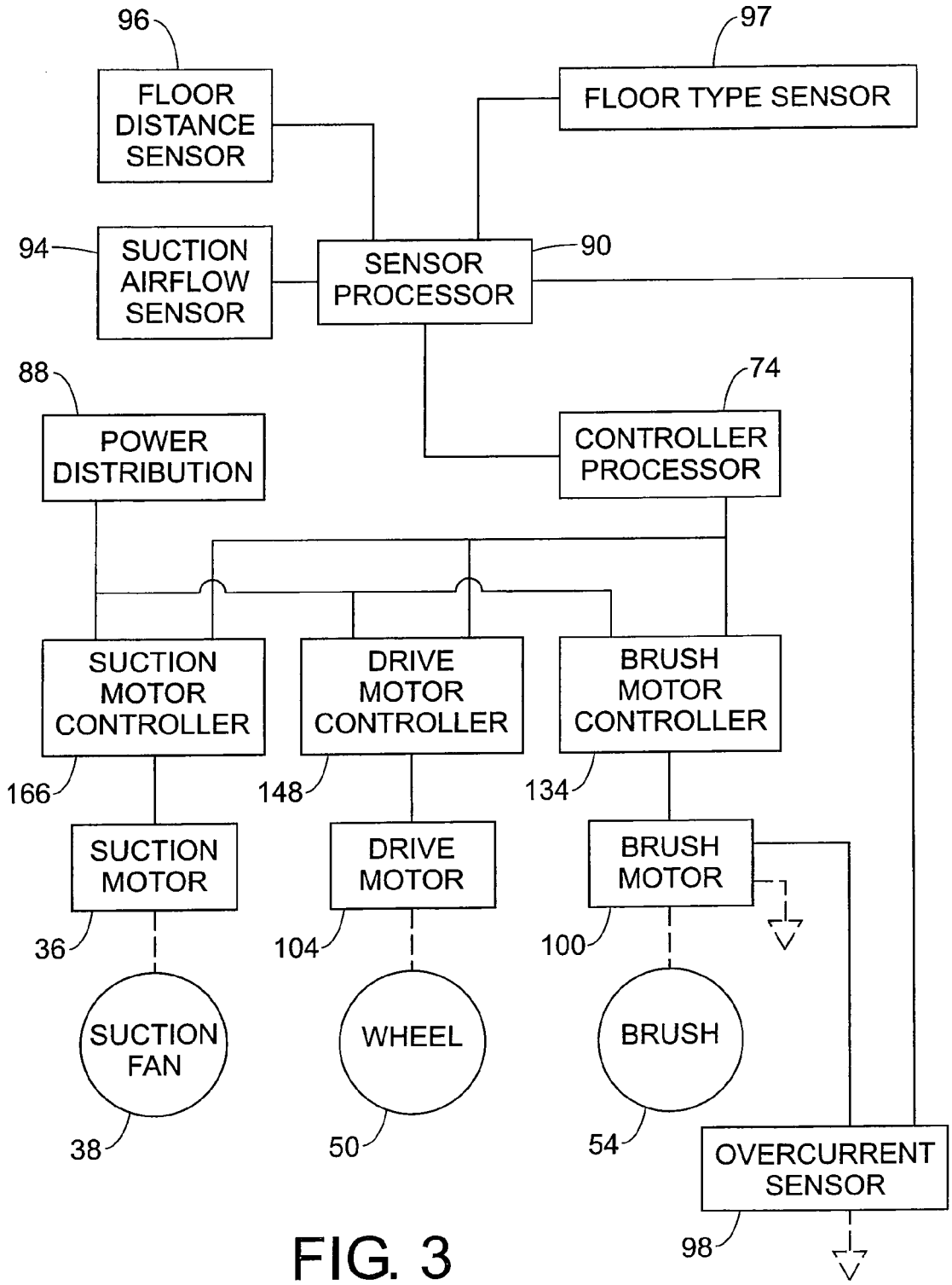
FIG. 3 is a functional block diagram of the robotic vacuum cleaner of FIG. 1.

With reference to FIG. 3, an embodiment of the robotic vacuum cleaner 10 includes the suction motor 36, suction fan 38, wheel 50, brush 54, a controller processor 74, a power distribution 88, a sensor processor 90, a suction airflow sensor 94, a floor distance sensor 96, a floor type sensor 97, a brush motor overcurrent sensor 98, a brush motor 100, a drive motor 104, a brush motor controller 134, a drive motor controller 148, and a suction motor controller 166. In one embodiment, the brush 54 and the brush motor 100 can be combined to form a belt-less brush motor. In a belt-less brush motor, as is known, the motor is housed in the brush. An exemplary sensor processor 90 includes a microcontroller model no. PIC18F252 manufactured by Microchip Technology, Inc., 2355 West Chandler Blvd., Chandler, Ariz. 85224-6199.

Power distribution 88 receives power from a power source and distributes power to other components of the vacuum cleaner 10 including the controller processor 74, sensor processor 90, brush motor controller 134, drive motor controller 148, and suction motor controller 166. The power source, for example, may be located in the controller 12 or in the cleaning head 14; or divided between both the controller 12 and the cleaning head 14. Power distribution 88 may be a terminal strip, discreet wiring, or any suitable combination of components that conduct electrical power to the proper components. For example, if any components within the vacuum cleaner 10 require a voltage, frequency, or phase that is different than that provided by the power source, power distribution 88 may include power regulation, conditioning, and/or conversion circuitry suitable to provide the required voltage(s), frequencies, and/or phase(s). In one embodiment, the power source is in the controller 12 (FIG. 2) and provides power to the cleaning head 14. In this embodiment, power is distributed from the controller 12 (FIG. 2) along wires within the hose 16 (FIGS. 1 and 2) to power distribution 88 for distribution throughout the cleaning head.

The sensor processor 90 processes information detected by the suction airflow sensor 94, floor distance sensor 96, floor type sensor 97, and overcurrent sensor 98. The sensor processor 90, for example, can be in communication with the controller processor 74 via discrete control signals communicated through hose 16 (FIGS. 1 and 2). The controller processor 74 can control the brush 54, wheel(s) 50, and suction fan 38 via brush motor controller 134, drive motor controller 148, and suction motor controller 166, respectively. Alternatively, the controller processor 74 may control one or more motors directly or via any type of suitable known device.

The suction airflow sensor 94, in combination with the sensor processor 90, detects if there is an obstruction in the suction airflow path of the vacuum cleaner. If there is an obstruction, the sensor processor 90 issues a visual indication via LED and a control signal to the controller processor 74 to shut the suction motor 36 off. If the suction motor 36 is not shut off when there is an obstruction in the suction airflow path, the suction motor 36 increases its speed. This can cause catastrophic failure to the suction motor 36 and potentially to the vacuum cleaner 10. The suction airflow sensor can be calibrated to be used as a maintenance sensor (for example clean filter, empty dirt receptacle, or change bag).

The suction airflow sensor 94, in combination with the sensor processor 90, detects an obstruction in the suction airflow path. In one embodiment, the suction airflow sensor 94 performs a differential pressure measurement between ambient air and the suction airflow path. In this embodiment, one of the differential pressure ports of the suction airflow sensor 94 is tapped to the atmosphere and the other port includes tapped to the suction airflow path. An exemplary differential pressure sensor includes model no. MPS5010 manufactured by Motorola, Inc. The sensor processor 90 can distinguish between a foreign object obstruction condition, a full dirt receptacle 32 (FIG. 2), and when the primary filter 34 (FIG. 2) needs to be changed. If desired, the sensor processor 90 can communicate the detected conditions to the controller processor 74 and the controller processor can determine whether the suction motor 36 (FIG. 2), brush motor 100 and drive motors 104 should be shut down or controlled differently and/or whether associated indicators should be illuminated and/or annunciators (i.e., alarms) should be sounded. Once the controller processor 74 determines a course of action, it communicates appropriate instructions to the appropriate motor controllers (i.e., 134, 148, 166).

In self-propelled vacuum cleaners, particularly a robotic vacuum cleaner, catastrophic failure will occur if stairs or other potential height changes in floor surfaces are not detected. To this end, the floor distance sensor 96, in combination with the sensor processor 90, detects height changes in floor surfaces and issues a control signal to the controller processor 74 for a stop and reverse command so that the vacuum cleaner 10 does not tumble down the stairs.

The floor distance sensor 96, in combination with the sensor processor 90, detects a drop-off in the floor that would cause the cleaning head 14 to hang up or fall. For example, the floor distance sensor 96 detects when the cleaning head 14 is at the top of a staircase or when the cleaning head approaches a hole or substantial dip in the surface area being traversed. In one embodiment, the floor distance sensor 96 can include two infrared (IR) sensors mounted approximately 5 cm off the ground at about a 20° angle normal to vertical. An exemplary IR floor distance sensor includes Sharp model no. GP2D120 manufactured by Sharp Corp., 22-22 Nagaiko-Cho, Abeno-Ku, Osaka 545-8522, Japan. The floor distance sensor 96 can communicate information to the sensor processor 90. In turn, the sensor processor 90 can communicate the detected conditions to the controller processor 74. The controller processor 74 controls the drive motors 104 to maneuver, for example, the cleaning head 14 in order to avoid the surface area when a hazardous surface condition is detected.

In combination with the sensor processor 90, the floor type sensor 97 can detect if a floor is carpeted or not. This is important since typically it is preferred to shut off the brush 54 if the vacuum cleaner is on a bare floor (e.g., hardwood floors, etc.) to protect the floor from damage caused by the brush.

The floor type sensor 97, in combination with the sensor processor 90, detects the type of floor being traversed and distinguishes between carpeted and non-carpeted surfaces. Floor type information is communicated to the controller processor 74. Typically, the controller processor 74 operates the brush motor 100 to spin the brush 54 when the surface area is carpeted and stops the brush motor 100 when non-carpeted surfaces are being cleaned. In one embodiment, the floor type sensor can use sonar to detect floor type. If used, a sonar floor type sensor can be mounted approximately 3 inches off the floor and can run at approximately 220 kHz. Using this arrangement, the sonar sensor can distinguish between, for example, low cut pile carpet and linoleum. Suitable sonar floor type sensors include sonar floor type sensors from Massa Products, a corporation of Hingham, Mass.

The overcurrent sensor 98, in combination with the sensor processor 90, can detect an unsafe current level in the brush motor 100. In operation, the vacuum cleaner 10 has the potential of picking up items (e.g., rags, throw rugs, etc.) that can jam the brush 54. When this happens the brush motor 100 can be in a locked rotor position causing the current and the motor to rise beyond its design specifications. An overcurrent sensor, in combination with the sensor processor 90, can detect this condition and turn off the brush motor 100 to avoid the potentially hazardous condition.

The overcurrent sensor 98, in combination with the sensor processor 90, can provide locked rotor and overcurrent protection to the brush motor 100. If the brush motor 100, for example, jams, brush motor current is increased. In one embodiment, the overcurrent sensor 98 can be an overcurrent feedback module associated with the brush motor 100. For example, if the brush motor is a brushless DC motor, the overcurrent feedback module can sense motor RPMs. Similarly, if the brush motor is a servo motor, the overcurrent feedback module can sense average torque on the motor. Additionally, the overcurrent feedback module may be an encoder that detects and measures movement of the brush motor shaft. In another embodiment, the overcurrent sensor 98 can be an electronic circuit that senses brush motor current and, in combination with the sensor processor 90, removes power from the brush motor 100 when an overcurrent condition is sensed. The overcurrent sensor 98 can be reset after, for example, a throw rug jamming the brush 54 is removed from the suction inlet 24 (FIG. 2). Also, the sensor processor 90 may communicate the overcurrent condition information to the controller processor so that additional appropriate actions can be taken during in overcurrent condition. For example, such actions can be stopping movement of the robotic vacuum 10 and activation of appropriate indicators and/or alarms.

Either the controller processor 74 or the sensor processor 90 can control drive functions for the cleaning head 14. The controller processor 74 is in communication with the drive motor 104 and associated steering mechanism. In one embodiment, the steering mechanism may move the caster 52 (FIG. 2) to steer the cleaning head 14. The drive motor 104 is in operative communication with the wheel 50 to turn the wheel forward or backward to propel the cleaning head 14. In another embodiment, the drive motor 104 may simultaneously control two wheels 50 and the steering mechanism may control the caster 52 (FIG. 2).

Figure 9:
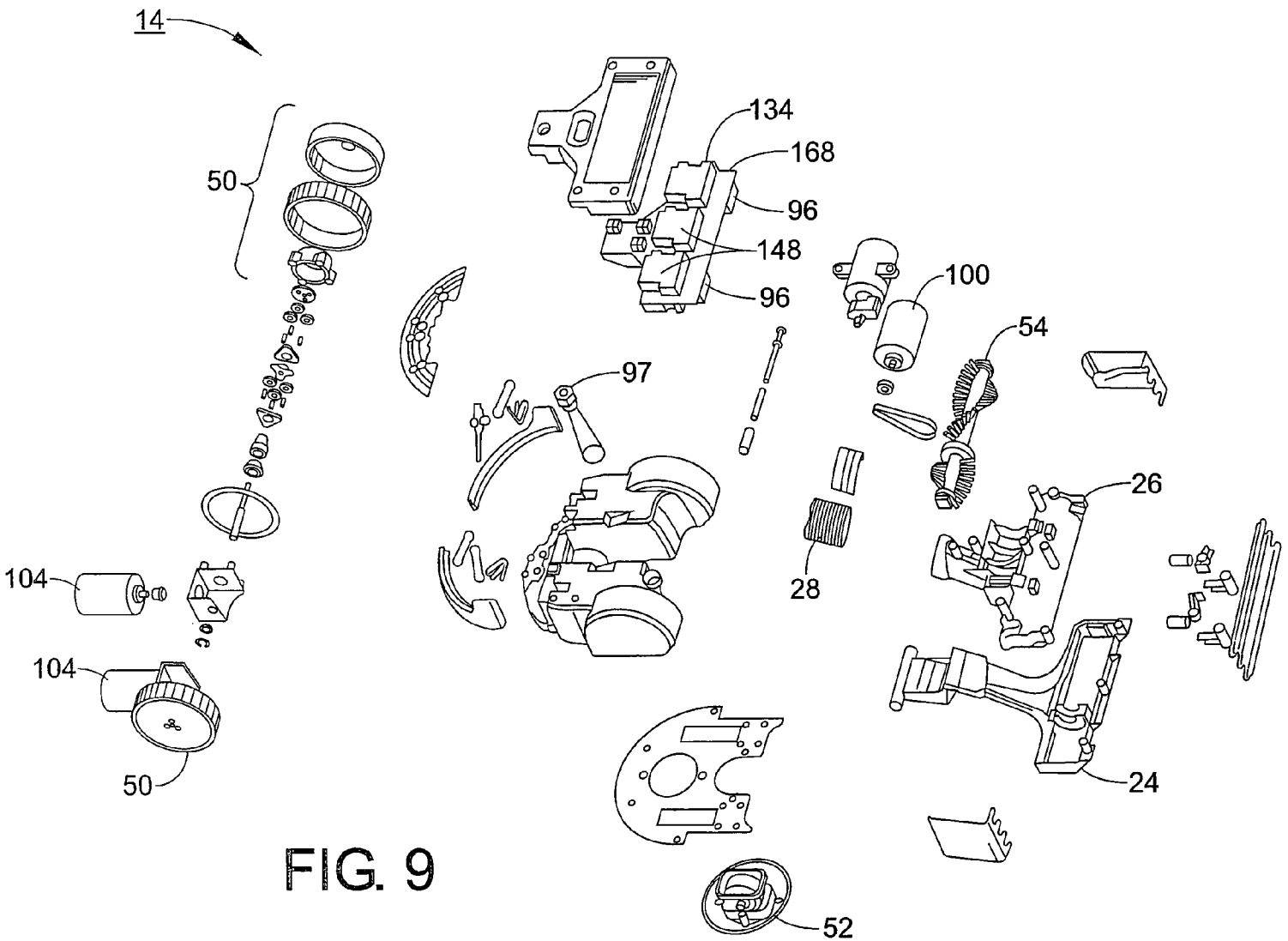
FIG. 9 is an exploded view an embodiment of a cleaning head associated with the robotic canister-like vacuum cleaner of FIGS. 1 and 2.

In still another embodiment, having two casters 54 (FIG. 2), the steering mechanism controls may control both casters independently or by a linkage between the casters. Alternatively, the additional caster may be free moving (i.e., freely turning about a vertical axis). If the cleaning head 14 includes additional casters, they may be free moving or linked to the steered caster(s). In yet another embodiment, as shown in FIG. 9, the cleaning head 14 can include two independent drive motors 104 and the processor can independently control the two wheels 50 to provide both movement and steering functions. In this embodiment, each independently controlled drive motor 104/wheel 50 combination provides forward and backward movement. For this embodiment, the controller processor 74 would control steering by driving the drive motor 104/wheel 50 combinations in different directions and/or at different speeds. Thus, a separate steering mechanism is not required.

The wheel 46, caster 48, and drive motor of the controller 12 (FIG. 2) typically operate in the same manner as like components described above for the cleaning head 14. Likewise, the various alternatives described above for the drive and steering components in the cleaning head 14 are available for the drive and steering components in the controller 12. It should also be appreciated that the wheel 46, caster 48, and drive motor of the controller 12 may implement one of the alternatives described above while the cleaning head 14 implements a different alternative.

In various embodiments, the functions performed by the controller processor 74 and sensor processor 90 may be combined in one or more processors or divided differently among two or more processors. The resulting processor(s) may be located in the controller 12 or the cleaning head 14 or divided between the controller 12 and the cleaning head 14. In the embodiment being described, the controller 12 and cleaning head 14 are typically assembled in separate housings. The various components depicted in FIG. 3 may be installed in either housing, unless the function of the component dictates that it must be installed in either the controller 12 or the cleaning head 14. For example, the brush 54 and brush motor 100 typically must be installed in the cleaning head. Alternatively, the components depicted in FIG. 3 may be embodied in a robotic vacuum cleaner having a single housing rather than the tandem configuration shown in FIGS. 1 and 2.

Figure 4:
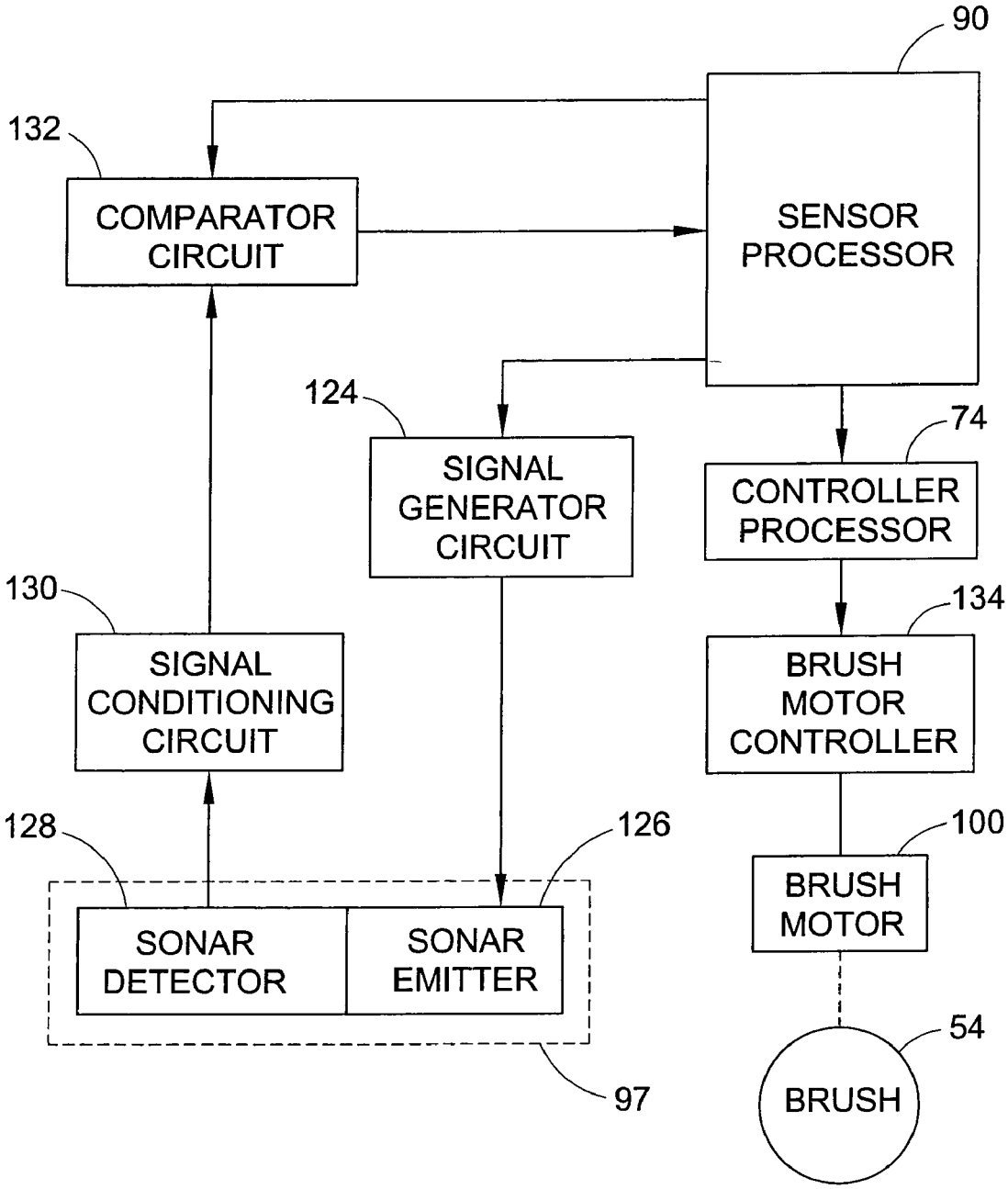
FIG. 4 is a more detailed functional block diagram of an embodiment of a vacuum cleaner circuit including a floor type sensor of FIG. 3.

With reference to FIG. 4, a vacuum cleaner circuit with a floor type sensor 97 also includes the brush 54, the controller processor 74, the sensor processor 90, the brush motor 100, the brush motor controller 134, a signal generator circuit 124, a signal conditioning circuit 130, and a comparator circuit 132. In one embodiment, the floor type sensor 97 is based on sonar technology and includes a sonar emitter 126 and a sonar detector 128. The sonar emitter 126 and the sonar detector 128 can be operatively coupled to a vacuum cleaner or other cleaning appliance via a mounting tube as described in connection with FIG. 11 below.

The sensor processor 90 can communicate a control signal to the signal generator circuit 124. In turn, the signal generator circuit 124 can provide a drive signal to the sonar emitter 126. The control and drive signals may, for example, be about 220 kHz. Normally, the drive signal would be a high voltage stimulus that causes the sonar emitter 126 to emit sonic energy in the direction of the floor to be sensed. Such energy is either reflected (in the case of a hard floor) or partially absorbed and scattered (in the case of a soft or carpeted floor). The reflected sonic energy is received by the sonar detector 128 and converted to an electrical signal, indicative of signal amplitude, echo width, and/or cleaning head height, for example, provided to the signal conditioning circuit 130.

Optionally, the signal conditioning circuit 130 conditions and filters the detected signal so that it is compatible with the comparator circuit 132. If desired, the comparator circuit 132 can be programmable and can receive a second input from the sensor processor 90. The input from the sensor processor 90 can act as a threshold for comparison to the detected signal. One or more predetermined threshold values may be stored in the sensor processor 90 and individually provided to the comparator circuit 132. The output of the comparator circuit 132 can be monitored by the sensor processor 90.

The comparator circuit 132 may be implemented by hardware or software. For example, in one embodiment the sensor processor 90 may include a look-up table (LUT) and a comparison process may include matching the detected signal to values in the look-up table where values in the look-up table identify thresholds for the detected signal for various types of floor surfaces. For example, hard floor surfaces, such as concrete, laminate, ceramic, and wood, and soft floor surfaces, such as sculptured carpet, low pile carpet, cut pile carpet, and high pile carpet.

The sensor processor 90 identifies the type of floor being traversed by the vacuum cleaner and communicates type of floor information to the controller processor 74. Based on the type of floor information, the controller processor 74 determines whether or not to operate the brush motor and provides a control signal to the brush motor controller 134 to start or stop the brush motor 100. The controller processor 74 may also control the speed of the brush motor 100 via the brush motor controller 134 if variations in speed, based on the type of floor detected, are desirable. It is to be appreciated that the speed of the brush motor 100 and/or the brush 54 can be dynamically controlled. Thus, at any given instance the speed of the brush motor 100 and/or the brush 54 can be increased and/or decreased depending on the type of floor and/or a floor characteristic (e.g., when moving from a worn region of carpet to an unworn region of the same or different carpet).

The brush motor controller 134, brush motor 100, and brush 54 operate as described above in relation to FIG. 3. In an alternate embodiment the brush motor controller 134 may not be required and either the controller processor 74 or the sensor processor 90 may directly control the brush motor 100. In still another embodiment, the sensor processor 90 may directly control the brush motor controller 134.

The vacuum cleaner circuit with the floor type sensor which has been described above, may be implemented in a robotic vacuum cleaner, a robotic canister-like vacuum cleaner, a hand vacuum cleaner, a carpet extractor, a canister vacuum cleaner, an upright vacuum cleaner, and similar indoor cleaning appliances (e.g., floor scrubbers) and outdoor cleaning appliances (e.g., street sweepers) that include rotating brushes.

Figure 5:
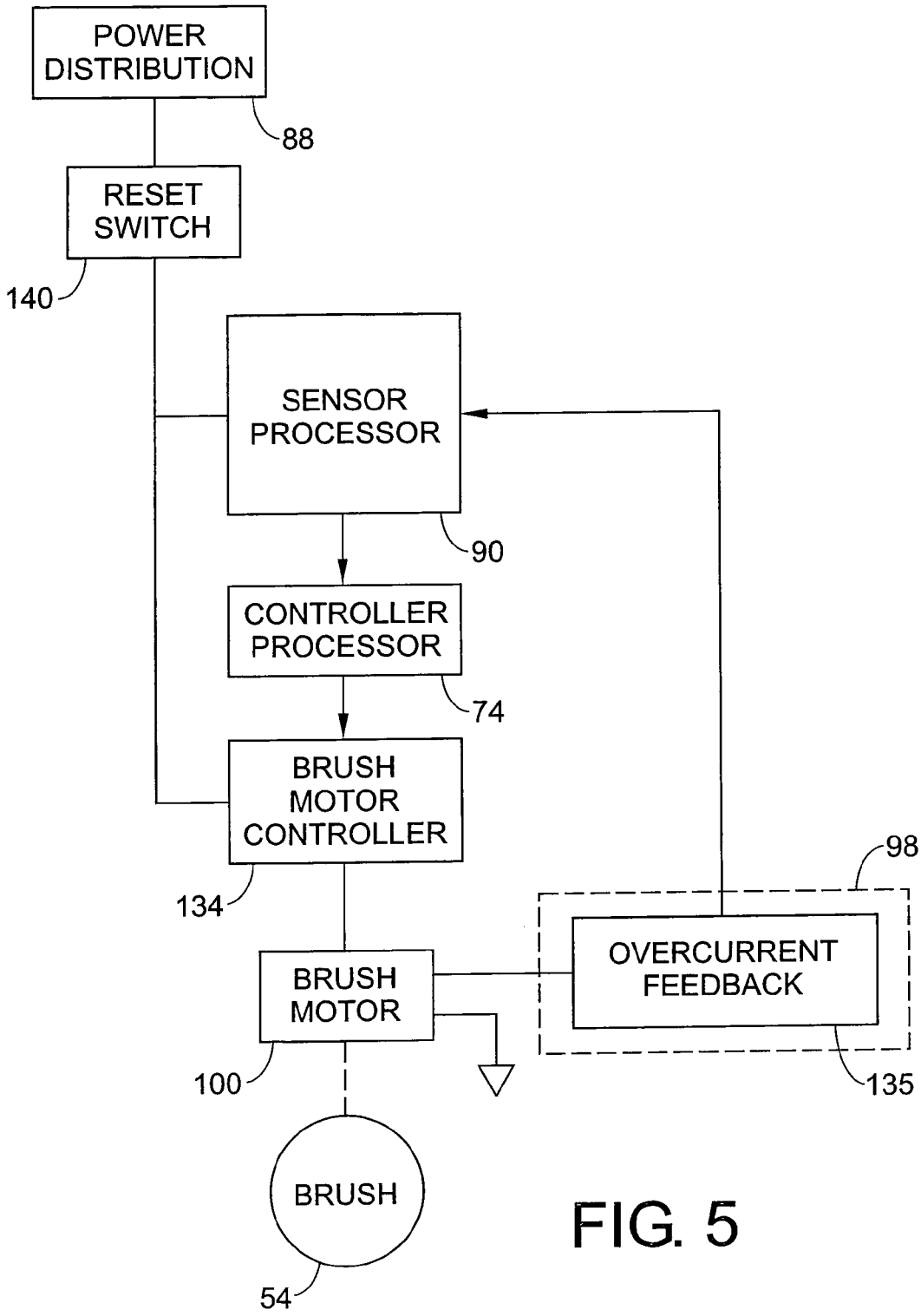
FIG. 5 is a more detailed functional block diagram of an embodiment of a vacuum cleaner circuit including a brush motor overcurrent sensor of FIG. 3.

With reference to FIG. 5, a vacuum cleaner circuit with a brush motor overcurrent sensor 98 also includes the brush 54, controller processor 74, power distribution 88, sensor processor 90, brush motor 100, brush motor controller 134 and a reset switch 140. In one embodiment, the overcurrent sensor 98 includes an overcurrent feedback module 135. The overcurrent feedback module 135, for example, may provide information associated with brush motor RPM, brush motor torque, quantity of brush motor revolutions, and/or distance of brush motor rotation. For example, where the brush motor is a brushless DC motor, the overcurrent feedback module 135 may provide information associated with brush motor RPM. Alternatively, where the brush motor is a servo motor, the overcurrent feedback module 135 may provide information associated with brush motor torque. For various types of brush motors, the overcurrent feedback module 135 may include, for example, encoders that provide information associated with the quantity of brush motor revolutions from a given point and/or the distance of brush motor rotation from a given point.

During operation of the brush motor 100, power flows from power distribution 88 through the reset switch 140 and the brush motor controller 134 to the brush motor 100. In the embodiment being described, the return path for power is connected to the brush motor 100. The sensor processor 90 monitors, for example, brush motor RPM via the overcurrent feedback module 135 and determines whether an overcurrent condition exists based on the brush motor RPM. The sensor processor 90 may, alternatively, monitor brush motor torque, brush motor revolutions, or distance of brush motor rotation as described above. The sensor processor 90 can compare the information provided by the overcurrent feedback module 135 to a predetermined threshold. If the feedback information is less than the predetermined threshold, the sensor processor 90 can send a control signal to the controller processor 74 and/or brush motor controller 134 to open the power connection to the brush motor 100. In the embodiment being described, the brush motor controller 134 remains open until the reset switch 140 is manually activated, thereby cycling power to the brush motor controller 134 and applying a control activation signal to the sensor processor 90. In other embodiments, the brush motor controller 134 may be reset by other suitable means. Once power is cycled by activation of the reset switch 140, the sensor processor 90 sends a control signal to close the power connection in the brush motor controller 134, thus enabling power to flow to the brush motor 100 through the brush motor controller 134.

The sensor processor 90 may communicate conditions associated with brush motor current to the controller processor 74. In turn, the controller processor 74 may use brush motor current information to control operation of the brush motor 100, including on/off and/or speed control. The brush motor controller 134, brush motor 100, and brush 54 can operate in the same manner as described above in reference to FIG. 3.

The vacuum cleaner circuit with the brush motor overcurrent sensor may be implemented in a robotic vacuum cleaner, a robotic canister-like vacuum cleaner, a hand vacuum cleaner, a carpet extractor, a canister vacuum cleaner, an upright vacuum cleaner, and similar household cleaning appliances that include a brush motor.

Figure 6:
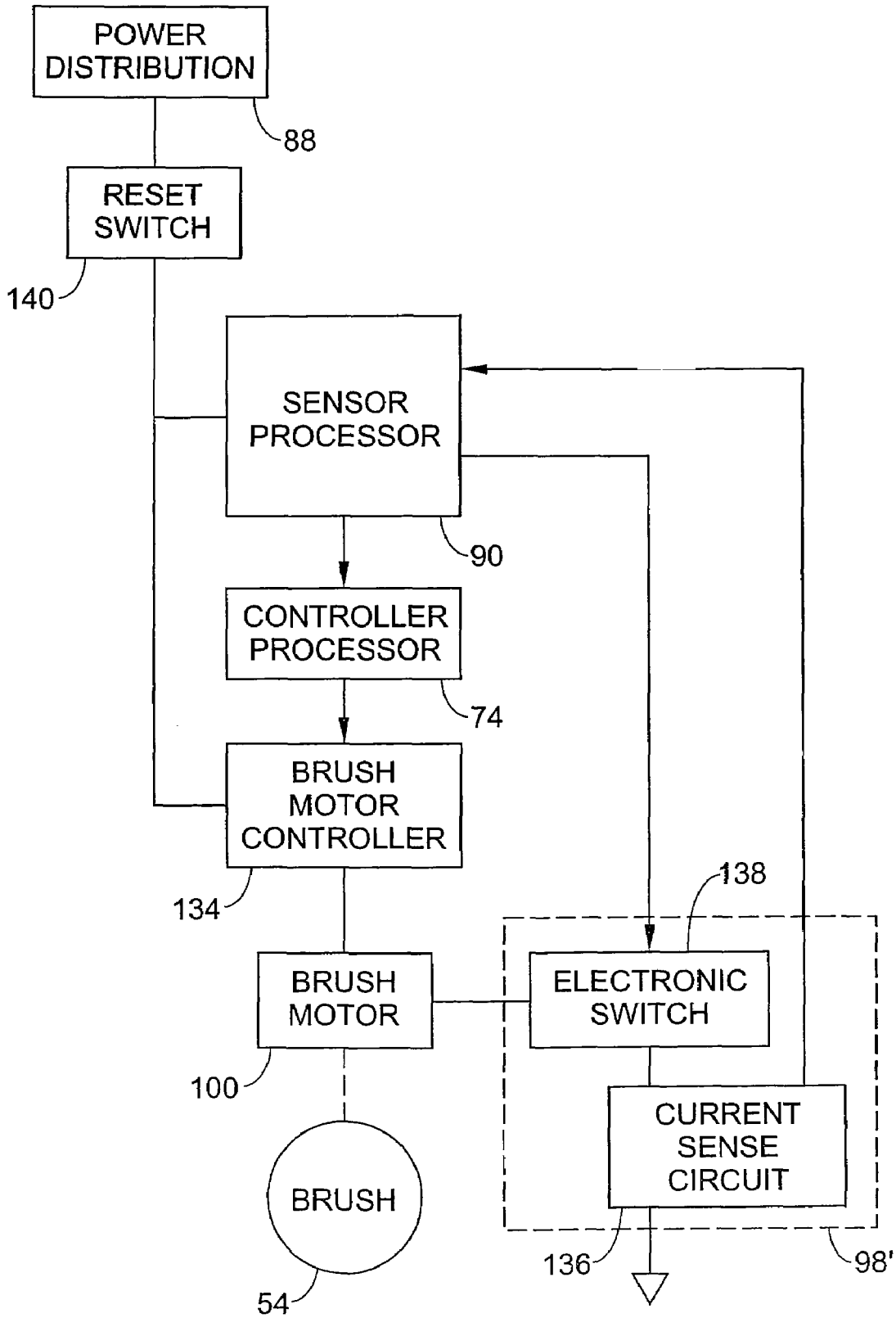
FIG. 6 is a functional block diagram of another embodiment of a vacuum cleaner circuit including the brush motor overcurrent sensor of FIG. 3.

With reference to FIG. 6, another embodiment of a vacuum cleaner circuit with a brush motor overcurrent sensor 98' also includes the brush 54, controller processor 74, power distribution 88, sensor processor 90, brush motor 100, brush motor controller 134 and a reset switch 140. In one example of the embodiment being described, the overcurrent sensor 98' includes a current sense circuit 136 and an electronic switch 138. An exemplary current sense circuit 136 includes a 0.05 ohm resistor, a 1K ohm resistor, and a 0.1 μF capacitor. An exemplary electronic switch 138 includes a field effect transistor (FET), a 1K ohm resistor, and a 10K ohm resistor.

During operation of the brush motor 100, power flows from power distribution 88 through the reset switch 140 and the brush motor controller 134 to the brush motor 100. In the embodiment being described, the overcurrent sensor 98' is in the return path between the brush motor 100 and ground. In other embodiments, the overcurrent sensor 98' may be located at other points in the brush motor current path. The sensor processor 90 monitors brush motor current via the current sense circuit 136. This circuit may include a current sense resistor that converts motor current to a voltage signal that is filtered and provided to the sensor processor 90. The sensor processor 90 can compare the sensed current to a predetermined threshold. If the sensed current exceeds the predetermined threshold, the sensor processor 90 can send a control signal to the electronic switch 138 to open the return path for power to the brush motor 100. In the embodiment being described, the electronic switch 138 remains open until the reset switch 140 is manually activated, thereby cycling power to the brush motor controller 134 and applying a control activation signal to the sensor processor 90. In other embodiments, the electronic switch 138 may be reset by other suitable means. Once power is cycled by activation of the reset switch 140, the sensor processor 90 sends a control signal to close the electronic switch 138, thus enabling power to flow through the brush motor 100 via the brush motor controller 134 under control of the controller processor 74 and sensor processor 90.

The sensor processor 90 may communicate conditions associated with brush motor current to the controller processor 74. In turn, the controller processor 74 may use brush motor current information to control operation of the brush motor 100, including on/off and/or speed control. The brush motor controller 134, brush motor 100, and brush 54 can operate in the same manner as described above in reference to FIG. 3.

The vacuum cleaner circuit with the brush motor overcurrent sensor may be implemented in a robotic vacuum cleaner, a robotic canister-like vacuum cleaner, a hand vacuum cleaner, a carpet extractor, a canister vacuum cleaner, an upright vacuum cleaner, and similar household cleaning appliances that include a brush motor.

Figure 7:
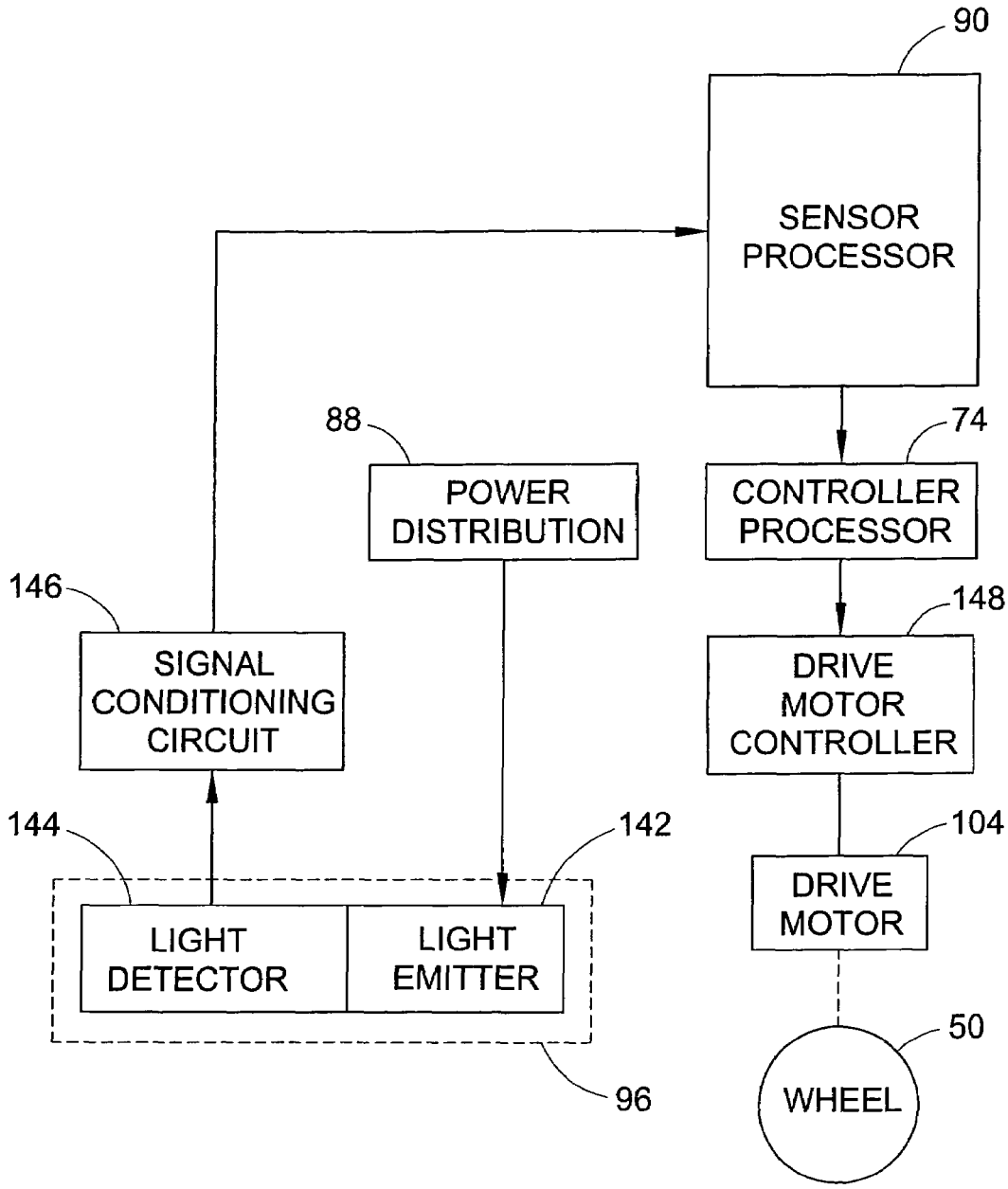
FIG. 7 is a more detailed functional block diagram of an embodiment of a vacuum cleaner circuit including a floor distance sensor of FIG. 3.

In reference to FIG. 7, a vacuum cleaner circuit with a floor distance sensor 96 also includes the wheel 50, controller processor 74, power distribution 88, sensor processor 90, drive motor 104, drive motor controller 148 and signal conditioning circuit 146. In one embodiment, the floor distance sensor includes a light emitter 142 and a light detector 144.

The power distribution 88 applies power to the light emitter 142. The light emitter 142 emits light energy toward a surface of a floor toward which the vacuum cleaner is advancing. Detecting the amount of light reflected by the floor is the light detector 144. The amount of light detected is indicative of the distance to the surface of the floor. Providing a detected signal to the signal conditioning circuit 146 is the light detector 144. The signal conditioning circuit 146 conditions and filters the signal for the sensor processor 90. Comparing the conditioned signal to a predetermined threshold is the sensor processor 90 to determine if there is a sudden increase in the distance, such as would occur when the vacuum cleaner approaches the edge of a downward staircase. The specific values of this distance threshold are programmable and dependent on sensor mounting and view angles. Two floor distance sensors 96 can be mounted on opposite edges of the vacuum cleaner to detect a stair edge when the vacuum cleaner is moving at any angle to a drop-off in the surface of the floor.

The sensor processor 90 identifies conditions in the floor surface that may be hazardous for a self-propelled vacuum cleaner. These potential hazardous conditions are communicated to the controller processor 74. The controller processor 74 controls the drive motor controller 148, which in turn controls the speed and direction of the drive motor 104 so that the vacuum cleaner avoids the potential hazardous condition. For example, when a potential hazardous condition is detected, the controller processor 74 may implement a control procedure that stops the vacuum cleaner from advancing, reverses the vacuum cleaner to back away from the potential hazardous surface condition, and activates localization sensors to localize the vacuum cleaner within the environment to be cleaned. Alternatively, the controller processor 74 may implement an edge following routine using the floor distance sensor 96 to advance the vacuum cleaner along the edge of the potentially hazardous surface condition. If desired, the drive motor controller 148, drive motor 104, and wheel 50 can operate in the same manner as described above in reference to FIG. 3. Likewise, as described above, multiple pairs of drive motors 104 and wheels 50 can be implemented and independently controlled to steer the vacuum cleaner. Alternatively, a steering mechanism can be implemented and controlled in conjunction with control of the drive motor 104 to avoid the potentially hazardous condition.

It is to be appreciated that the speed of the drive motor 104 and/or and the wheels 50 can be dynamically controlled. Thus, at any given instance the speed of the drive motor 104 and/or and the wheels 50 can be increased and/or decreased depending on the type of floor and/or a floor characteristic (e.g., when moving from a worn region of carpet to an unworn region of the same or different carpet). The vacuum cleaner circuit with the floor distance sensor may be implemented in a robotic vacuum cleaner, a robotic canister-like vacuum cleaner, a self-propelled carpet extractor, a self-propelled canister vacuum cleaner, a self-propelled upright vacuum cleaner, and similar cleaning units (e.g., street sweeper, lawn mower, floor polisher) that are self-propelled.

Figure 8:
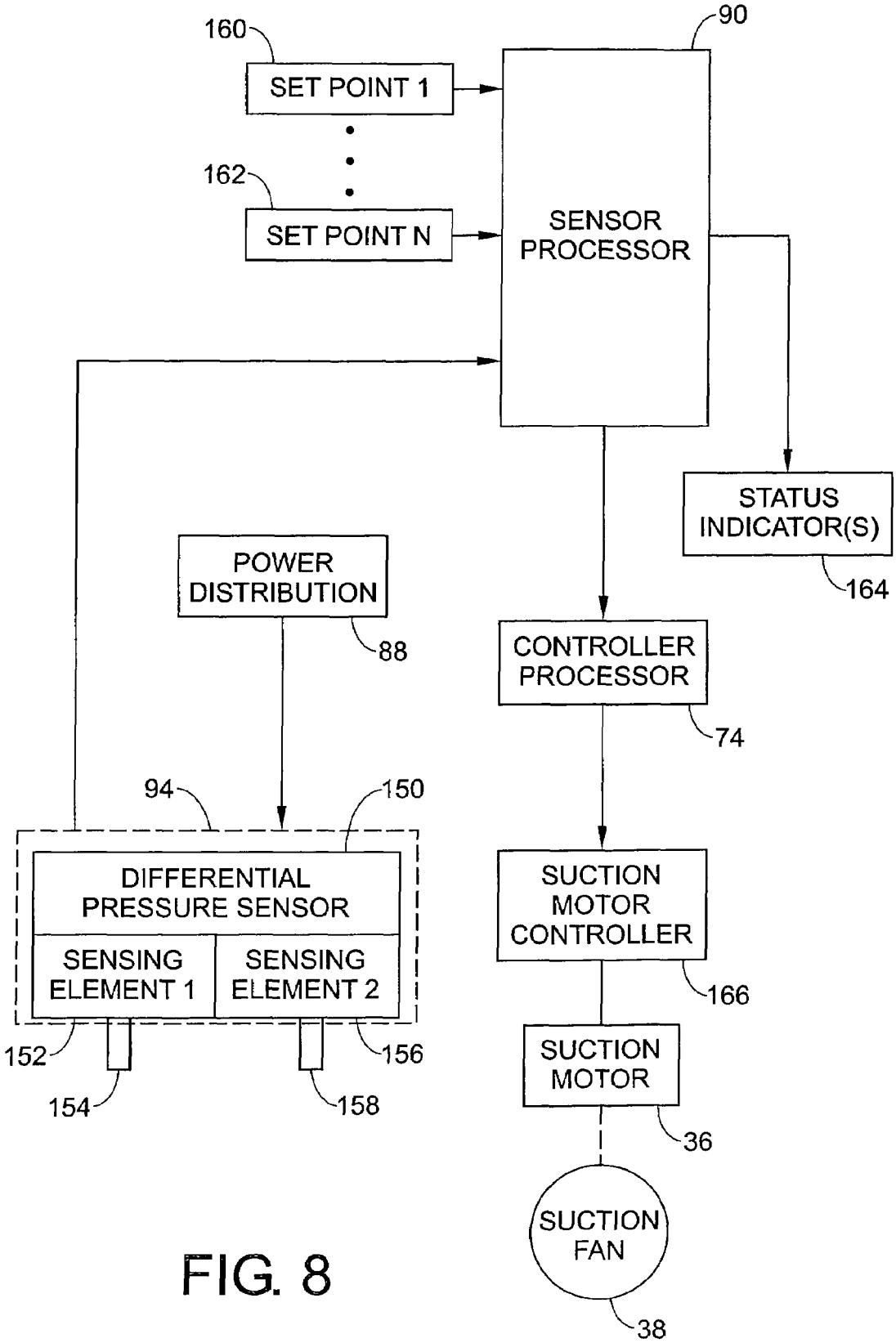
FIG. 8 is a more detailed functional block diagram of an embodiment of a vacuum cleaner circuit including a suction airflow sensor of FIG. 3.

With reference to FIG. 8, a vacuum cleaner circuit with a suction airflow sensor 94 also includes the suction motor 36, suction fan 38, controller processor 74, power distribution 88, sensor processor 90, suction motor controller 166, a plurality of set points (including a first set point 160 and an Nth set point 162), and one or more status indicator(s) 164. In one embodiment, the suction airflow sensor 94 includes a differential pressure sensor 150 with a first sensing element 152, a first pressure sensing port 154, a second sensing element 156, and a second pressure sensing port 158. The first sensing port 154 is associated with the first sensing element 152 and the second sensing port 158 is associated with the second sensing element 156.

The differential pressure sensor 150 converts a difference in pressure across the two sensing ports to a signal that is provided to the sensor processor 90. The sensor processor 90 compares the sensed signal to one or more predetermined set points (160, 162). Any or all set points can be implemented in hardware (e.g., variable resistors) or software. Depending on the results of the comparison, the sensor processor 90 updates the one or more status indicators 164 to reflect the sensed differential pressure.

One sensing port (e.g., 154) can measure the pressure in the suction airflow path and the other sensing port (e.g., 158) can measure the pressure of ambient air near the vacuum cleaner. The difference in pressure can be used to determine varying degrees of obstruction within the suction airflow path. For example, individual set points (e.g., 160, 162) can be calibrated to represent thresholds for differential pressure measurements that are expected when the suction airflow path is obstructed by a foreign object, when a dirt receptacle associated with the vacuum cleaner is generally full, and when a filter associated with the vacuum cleaner is generally blocked. In other words, the first set point 160 may be adjusted to act as a threshold for determining when the suction airflow path is obstructed by a foreign object, a second set point may be adjusted to act as a threshold for determining when the dirt receptacle is generally full, and a third set point may be adjusted to act as a threshold for determining when the filter is generally blocked.

The status indicator 164 may include an illuminated indicator, an annunciator, or a combination of both. If the sensor processor 90 can identify multiple conditions for the vacuum cleaner based on different differential pressure measurements, it is preferred that the status indicator be able to provide multiple types of indicator sequences with a unique indicator sequence associated with each unique detectable condition. The illuminated indicator can have multiple illuminated display sequences and the annunciator can have multiple audible tone sequences.

For example, the illuminated indicator may include a tricolor LED with red, yellow, and green sections. The sensor processor 90 may illuminate the red section when the suction airflow path is obstructed by a foreign object and the yellow section when the dirt receptacle is generally full. The sensor processor 90 may illuminate and flash the yellow section when the filter is generally blocked, and the green section when the suction airflow path is suitable for normal vacuuming operations. Of course, alternate color schemes and alternate display characteristics are also possible. The annunciator may be used in combination with the illuminated indicator or in place of the illuminated indicator. Similarly, the sensor processor 90 can control the annunciator to sound unique audible tone sequences for each detectable condition.

It is to be appreciated that the speed of the suction motor 36 and/or the suction fan 38 can be dynamically controlled. Thus, at any given instance the speed of the suction motor 36 and/or the suction fan 38 can be increased and/or decreased depending on the type of floor and/or a floor characteristic (e.g., when moving from a worn region of carpet to an unworn region of the same or different carpet ). The vacuum cleaner circuit with the suction airflow sensor may be implemented in a robotic vacuum cleaner, a robotic canister-like vacuum cleaner, a hand vacuum cleaner, a carpet extractor, a canister vacuum cleaner, a stick vacuum cleaner, an upright vacuum cleaner, and any other type of cleaning unit (e.g., street sweeper) that includes a suction airflow path.

With reference to FIG. 9, an exploded view of an embodiment of a cleaning head 14 associated with a canister-like vacuum cleaner 10 is provided. This view shows the suction inlet 24, brush chamber 26, suction conduit 28, two wheels 50, caster 52, brush 54, two floor distance sensors 96, a floor type sensor 97, a brush motor 100, two drive motors 104, a brush motor controller 134, two drive motor controllers 148, and a circuit card assembly 168. The circuit card assembly 168 may include various components and one or more of the electronic circuits described above, including the sensor processor 90, suction airflow sensor 94; and overcurrent sensor 98. Of course, electronic circuits and various components could be divided among multiple circuit card assemblies in any suitable manner. Similarly, the circuit card assemblies may be disposed in any suitable location throughout the vacuum cleaner.

Figure 10:
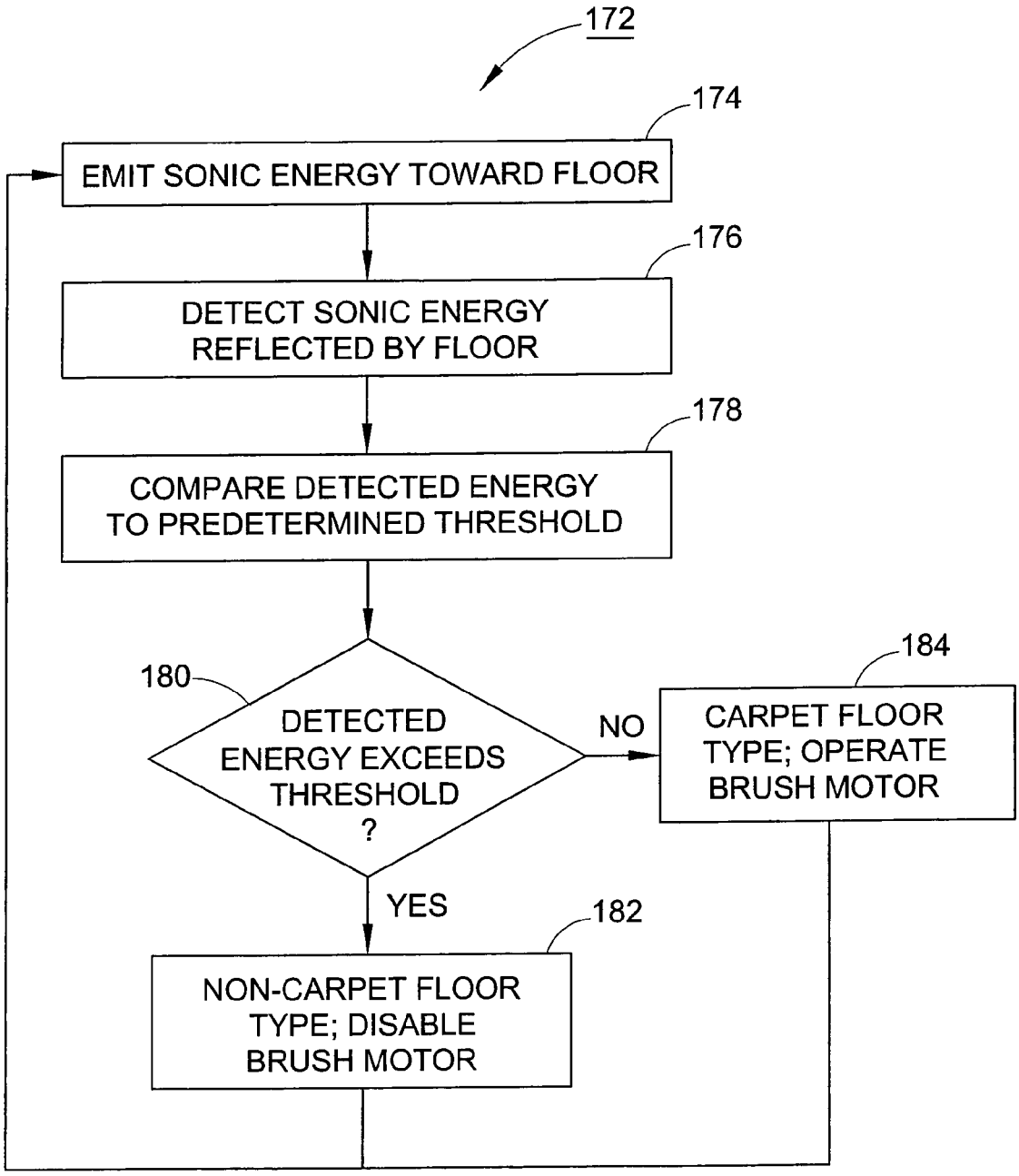
FIG. 10 is a flowchart of an embodiment of a floor type sensing and control process for a vacuum cleaner according to the present invention.

With reference to FIG. 10, a floor type sensing and control process 172 for a vacuum cleaner begins at step 174 when a floor type sensor emits sonic energy toward the floor. Next, at step 176, sonic energy reflected by the floor is detected by the floor type sensor. The detected sonic energy is compared to a predetermined threshold (step 178). At step 180, the process determines whether or not the detected sonic energy exceeds the predetermined threshold. If the detected sonic energy exceeds the predetermined threshold, the floor type is non-carpet or hard and the brush motor is disabled (step 182). Otherwise, the floor type is carpet or soft and the brush motor is operated (step 184). As shown, steps 174-184 are periodically repeated while power is applied to the vacuum cleaner. In an alternate embodiment, the detected sonic energy is compared to a plurality of values in an LUT, each LUT value representing a different type of floor. Depending on the type of floor detected, various predetermined. control procedures are activated. For example, a given predetermined control procedure may include adjusting the speed of the brush motor associated with the vacuum cleaner to a preferred speed for that type of floor. Another example of a predetermined control procedure is where the vacuum cleaner is a carpet extractor and the control procedure includes selecting a preferred cleaning solution and/or dispensing a preferred quantity of cleaning solution based on the type of floor being traversed.

Figure 11:
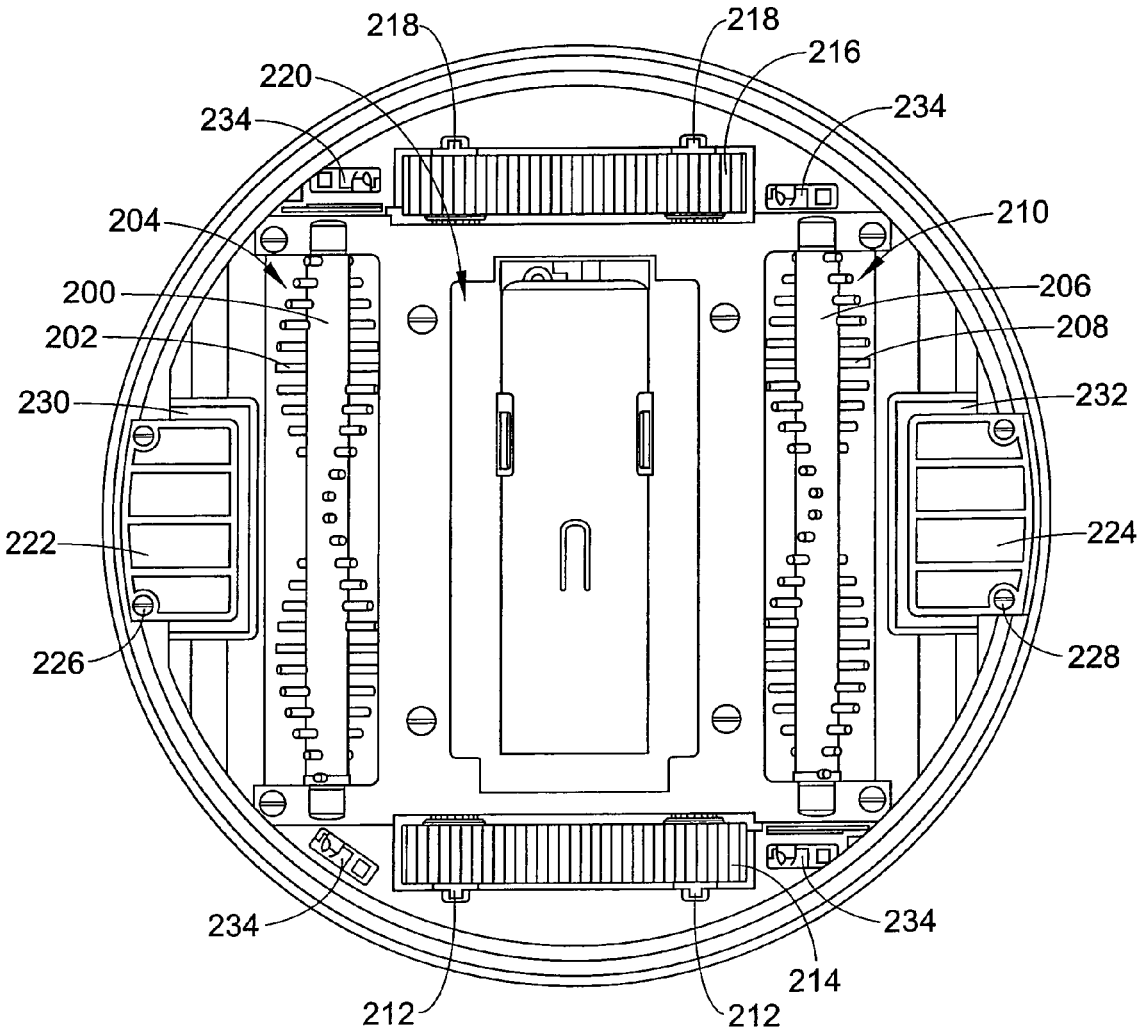
FIG. 11 is a bottom plan view of a powered cleaning appliance according to a second embodiment of the invention.

With reference to FIG. 11, a bottom view of a powered cleaning appliance is illustrated. A typical powered cleaning appliance includes a housing, a removable dirt cup located in the housing, a brushroll assembly located in the housing, a drive assembly located in the housing, and a bumper mounted to the housing. Such appliance can be an autonomous sweeper that may or may not include a conventional suction source, such as, for example, a motor driven fan that would direct airflow into the dirt cup. Furthermore, the appliance may or may not have an upright handle (e.g., similar to a conventional upright vacuum cleaner) that provides a user of the appliance with a mechanism to direct the movement of the appliance.

A first brushroll dowel 200 having bristles 202 extending from it rotates about a first brushroll shaft within a first brushroll chamber 204. In one instance, a first brushroll motor drives a first pinion that engages a. first toothed brushroll belt. The first brushroll motor can rest in a compartment and/or chamber defmed in the housing, and typically rests in a base of the housing. The first brushroll belt engages a toothed portion of the first brushroll dowel 200, and rotational motion of the first brushroll motor drive translates to rotational motion of the first brushroll dowel 200 about the first brushroll shaft.

A second brushroll dowel 206 is disposed on an opposite side from the first brushroll dowel 200. The second brushroll dowel 206 having bristles 208 extending from it rotates about a second brushroll shaft within a second brushroll chamber 210 in a substantially similar manner as described above in connection with the first brushroll dowel 200. That is, in one instance a second brushroll motor drives a second pinion that engages a second toothed brushroll belt, which engages a toothed portion of the second brushroll dowel 206. Rotational motion of the second brushroll motor drive translates to rotational motion of the second brushroll dowel 206 about the second brushroll shaft. Likewise, the second brushroll motor can rest in a compartment and/or chamber defmed in the housing, and typically rests in a base of the housing.

It is to be appreciated that although brushroll assemblies have been described as each having a pinion that drives a toothed belt, the brushroll motor can drive the brushroll through interengagaing gears or another known transmission.

The powered cleaning appliance can be propelled to move by a drive assembly. In one embodiment, a first drive motor (e.g., a reversible electric motor) drives a drive sprocket through a gear reduction transmission assembly encased in a gear housing and a gear housing cover. The drive sprocket engages and drives a toothed drive belt, which drives at least one toothed track pulley wheel 212. In turn, the driven track pulley wheel drives a first belt tread 214 that surrounds the first track pulley wheel 212 and at least one other track pulley wheel 212 spaced from the first track pulley wheel 212. The first and second track pulley wheels 212 receive first and second drive pins that attach to the housing so that the pulley wheels are attached to the housing.

A second drive motor drives a second belt tread 216 through components similar to the drive assembly described above. The second belt tread 216 surrounds track pulley wheels 218, both mounted to the housing. The second belt tread 216 is disposed on an opposite side of the appliance from the first drive tread 214 and can be driven independently thereof. Such a configuration allows for the appliance to rotate about its central axis easily by driving one motor at one speed while driving the other motor at another speed or, perhaps, in the opposite direction. Because the appliance can include two separate drive assemblies, it can easily turn without complicated differential gears and the like. In an alternative embodiment, the appliance could simply include one or more driven wheels that are driven through one or more suitable known transmissions.

Both the drive assemblies and the brushroll assemblies are driven by a power source. An opening 220 between the brushroll chambers 204 and 210 receives the power source. A rechargeable battery type power source is disclosed in this embodiment; however, the power source can be any conventional power source including an AC power source from a wall outlet, a solar power source, or a disposable battery power source. A battery pack assembly, which can include one or more batteries, can fit into the opening 220 into a suitably shaped lower wall of the dirt cup housing. Battery pack contacts are provided to electrically connect the brushroll motors and the drive motors to the power source. A charging jack can be provided in electrical communication with the batteries to facilitate charging the batteries. In the depicted embodiment, the battery pack assembly is centrally located in the base of the housing. It is to be appreciated that they can be located elsewhere in the housing, for example, to facilitate increasing the size of the dirt cup. By way of example, a set of batteries can be located toward each belt tread 214 and 216 or toward each brushroll chamber 204 and 210. The batteries could also be located elsewhere in the appliance and electrically connect to the brushroll assemblies and the drive assemblies.

A plurality of brackets 222 and 224 facilitate attaching bumpers to the housing. Each bracket 222 and 224 can be a generally rectangular plate having openings that receive fasteners to attach each bracket to the bumper. Such bumpers can be movably mounted to the housing. In one instance, the bumpers are substantially circular shells that at least substantially surround the housing. The bumpers can include a central opening that allows the dirt cup to be lifted away from the housing without having to remove the bumper. Fasteners 226 attach the bracket 222 to one or more bumpers, and fasteners 228 attach the bracket 224 to the housing. The first bracket 222 fits into a recess 230 formed in a bottom wall of the base of the housing. The recess 230 is generally shaped similar to that of the bracket 222, and is slightly larger than the bracket 222 to allow for movement of the bracket in the recess 230. Similarly, the bracket 224 fits into a second recess 232 in the bottom wall. The second recess 232 is similarly shaped to and on an opposite side of the appliance from the recess 230.

Movement of the appliance can also be controlled by one or more floor sensor assemblies 234 that can deliver a signal to the drive motors. The floor sensor assemblies 234 can be positioned such that at least one of the floor assemblies 234 is located forward the first belt tread 214 and at least one of the floor sensor assemblies 234 is located forward the second belt tread 216. In addition, at least one of the floor sensor assemblies 234 can be located rearward the first belt tread 214, and at least one of the floor sensor assemblies 234 can located rearward the second belt tread 216. The floor sensor assemblies 234 can include infrared, sonar, etc. sensors with an emitter and corresponding detector.

Sonar sensors emit sonic energy and receive return signals reflected and/or scattered by an object (e.g., floor surface). The received signals can be processed by sensor processor componentry to measure signal amplitude and echo width, either of which can be compared, for example by comparator, with predetermined limits to detect multiple different types of floors as well as other information. In addition, the received signals can be processed by sensor processor componentry to determine the height of the cleaning head. For example, the time between signal transmission and return signal reception can be used to determine the height. The measured signal amplitude, echo width, and/or cleaning head height can be used by the sensor processor and/or suction motor controller to determine whether to activate, de-activate, and/or adjust operation of the suction motor and/or associated alarms (e.g., visual and audible). Cleaning head height information can additionally be used to discriminate desired signals from interfering signals. For instance, the measured height can be used to discard signals that are deemed too close or too far away to be valid signals.

Figure 12:
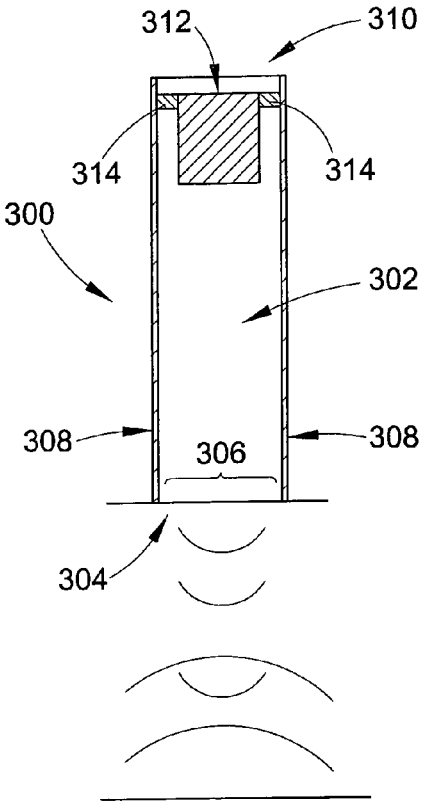
FIG. 12 is a view of an exemplary sonar sensing device for a cleaning appliance according to an embodiment of the invention.

With reference to FIG. 12, an exemplary sensor is there shown. It will be described in connection with a technique for operatively coupling and employing one or more sensors with various cleaning appliances. Examples of suitable cleaning appliances include, but are not limited to, upright vacuum cleaners, canister vacuum cleaners, carpet extractors, other types of vacuum cleaners, other types of robotic vacuums, and robotic household appliances, both indoor, such as floor polishers, and outdoor, such as lawnmowers or window washing robots. In one instance, this technique is used to adapt one or more sonar sensors to cooperate with the floor type sensor 97 as described in FIG. 4, supra, and/or FIG. 16, infra. However, it is to be understood that other types of sensors can additionally or alternatively be adapted to cooperate with the floor type sensor 97. The following will describe non-limiting applications in connection with upright and canister vacuum cleaners for illustrative purposes and sake of brevity.

A mounting tube 300 defining a volume 302 is adapted to mount to a portion of a floor nozzle of a cleaning appliance such as a vacuum cleaner. The mounting tube 300 can be variously shaped, depending on the shape of the cleaning appliance. For instance, the shape of the mounting tube 300 can be rectangular, circular, irregular, etc. A first end portion 304 of the mounting tube 300 faces a floor surface, or other surface being cleaned, during a typical cleaning operation. The first end portion 304 includes an opening 306 into the volume 302. Typically, the opening 306 encompasses a substantial portion of the first end portion 304. For instance, the opening 306 can extend to one or more walls 308 of the mounting tube 300. In other instances, the opening 306 may not extend to the walls 308 and/or may asymmetrically or symmetrically extend to some defined limit within the first end portion 304.

A second end portion 310 of the mounting tube 300 opposes the first end portion 304. A sensor 312 is operatively coupled proximate the second end portion 310 through essentially any known connecting means such as mounting brackets, screws, rivets, adhesive, wire, solder, etc. It is to be understood that more than one sensor 312 can be operatively coupled proximate to the second end portion 310. Depicted is a non-limiting technique employing sensor mount(s) 314, which can be formed from one or more mounting mechanisms. Furthermore, the sensor 312 is illustrated as being affixed within the mounting tube 300 relatively near the second end portion 310. It is to be understood that in alternative embodiments, the sensor 312 can be positioned closer to either the first end portion 304 or the second end portion 310 than depicted in FIG. 12.

The sensor 312 can be a sonar and/or other type of sensor. The following describes an exemplary instance in which the sensor 312 is a sonar sensor. As such, the sensor 312 includes an emitter (e.g., the sonar emitter 126 in FIG. 4 and FIG. 16) and a sonar detector (e.g., the sonar detector 128 in FIG. 4 and FIG. 16). The emitter and the detector components can be physically distinct components joined to cooperate or an individual unit (e.g., a transceiver) that both emits and senses signals (e.g., via half and full duplex). Sonic energy emitted from the sensor 312 longitudinally traverses through the volume 302 of the mounting tube 300 to the first end portion 304 where it exits the first end portion 304. At least a portion of the sonic waves that exit the first end portion 304 are absorbed, scattered and/or reflected by a region (e.g., a floor) lying outside of the first end portion 304 of the mounting tube 300. At least a portion of the reflected and/or scattered sonic energy re-enters the first portion 304 of the mounting tube 300 and travels back to the sensor 312 where it is received by the sonar sensor 312. One benefit of the mounting tube 300 is that it focuses the sonic waves being emitted toward the subjacent surface. It also focuses the reflected sonic waves as they travel towards the sensor 312.

The received sonic energy typically is converted to an electrical and/or mechanical signal, and can be indicative of various characteristics such as signal amplitude, echo width, and height (e.g., of a cleaning head). The signal obtained therefrom can be compared to one or more predetermined threshold signals. One or more predetermined threshold values may be stored and individually and/or concurrently compared with the signal. The comparison can include comparing the signal with values stored in a look-up table (LUT). For example, the signal can be compared with values in a LUT that maps floor type to signal amplitude and/or echo width to determine a floor type. Examples of floor types include, but are not limited to, relatively hard and soft surfaces, smooth and textured surfaces, new and old surfaces, waxed and unwaxed surfaces, etc. Examples of hard floor surfaces include, but are not limited to, concrete, laminate, ceramic, and wood, and examples of soft floor surfaces include, but are not limited to, sculptured carpet, low pile carpet, cut pile carpet, and high pile carpet. The cleaning appliance can be variously controlled based on the type of floor as described in detail herein. For example, the floor type can be used to determine whether to activate or continue operating the suction motor 36, the drive motor 104, and/or the brush motor 100.

In one non-limiting example, processing of the received sonic energy can be performed local to and/or remote from the vacuum cleaner. For example, the vacuum cleaner can include a signal processor (e.g., the sensor processor 90) and associated componentry that processes and analyses the received sonic energy and makes control decisions therefrom. In another example, the received sonic energy can be conveyed to a remote computing system (e.g., through a wire and/or wireless network, a bus, etc.). Such remote system can process and analyze the received sonic energy and return the processed data and/or control information. In yet another example, a combination of local and remote processing componentry can be used to process and analyze the received sonic energy and render control decisions. It is to be appreciated that such processing capabilities can include intelligence such as inference engines, classifiers, neural networks, etc. and employ statistics, probabilities, heuristics, etc. to facilitate analysis and decision making.

In another non-limiting example, a time differential between transmission of the sonic energy by the sensor 312 and reception of a corresponding echo by the sensor 312 is computed to determine a height of an associated cleaning head, for example, and/or to filter noise or interfering signals. For determining cleaning head height, the time differential can be compared to one or more values (e.g., from a LUT) that map time differences to height. Interpolation or other techniques can be used where the time differential does not directly map to any particular value. For filtering, a lower and/or an upper threshold that defines a range of values that are considered to be within a range of valid values can be defined. Such range can be based on probabilities, likelihoods, confidence intervals that balance accepting noise signals as valid signals (false positive) and discarding valid signals as noise (true negative). By example, the lower and/or upper thresholds can be used to exclude or discard signals that are too close or too far, based on the measured height, from the sensor 312 as erroneous signals. In order allow for closer mounting of the sensor 312 to the floor, the signal threshold can be adjusted and/or damping circuitry can be used to damp the transducing components of the sensor 312.

The shape of the mounting tube 300 and/or the location of the sensor 312 within the mounting tube 300 can also be used to further direct and/or amplify the effects of the signal transmission and echo return. Moreover, the shape of the mounting tube 300 and/or the location of the sensor 312 can facilitate eliminating extraneous signals.

Figure 13:
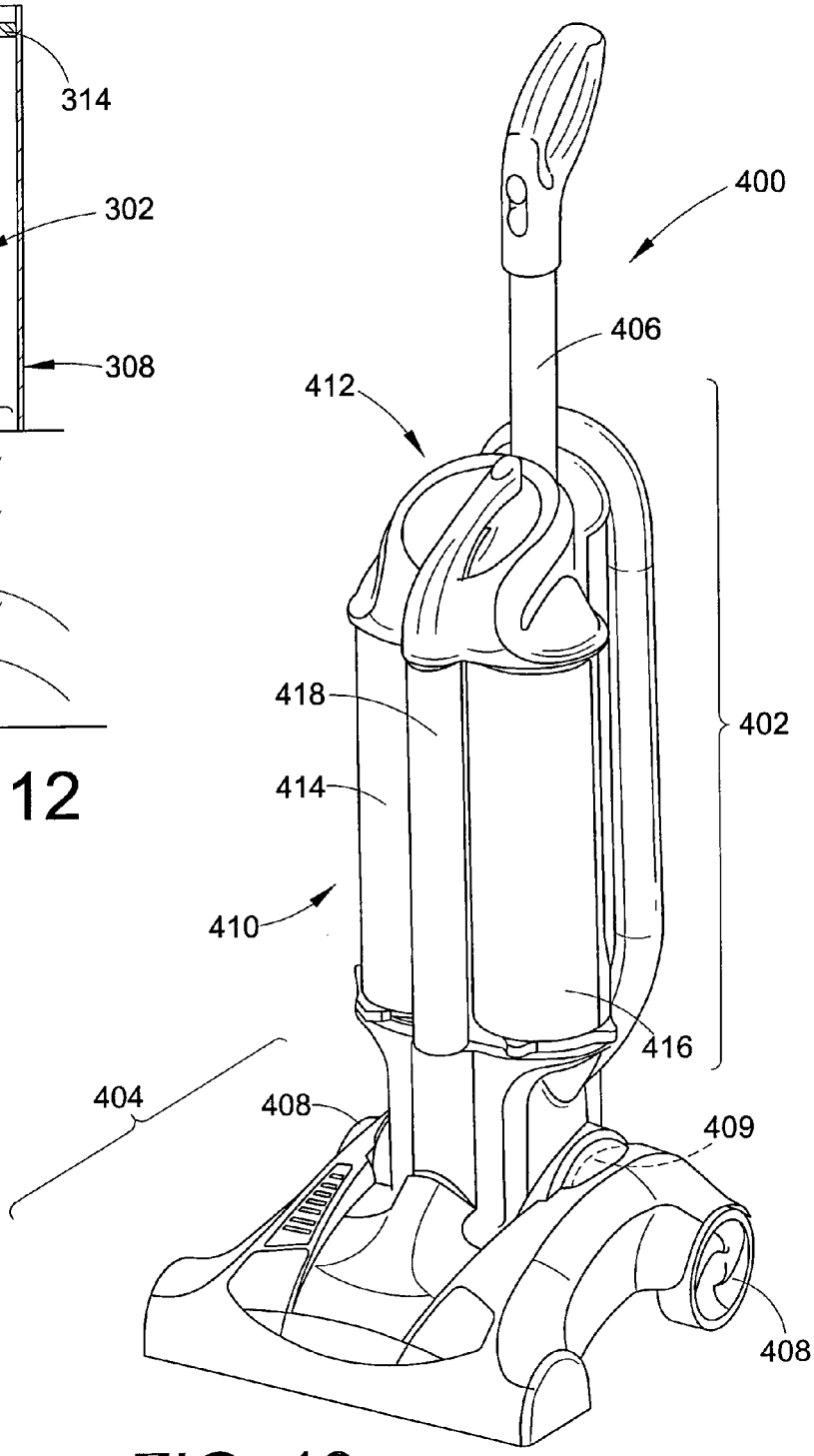
FIG. 13 is a view of a bagless upright vacuum cleaner according to a third embodiment of the invention.

With reference to FIG. 13, an upright bagless vacuum cleaner 400 includes an upright housing section 402 and a nozzle base section 404. The sections 402 and 404 are pivotally or hingedly connected through the use of trunnions or another suitable hinge assembly so that the upright housing section 402 pivots between a generally vertical storage position (as shown) and an inclined use position. The upright section 402 includes a handle 406 extending upward therefrom, by which an operator of the vacuum cleaner 400 is able to grasp and maneuver the vacuum cleaner 400.

During vacuuming operations, the nozzle base 404 travels across a floor, carpet, or other subjacent surface being cleaned. An underside of the nozzle base includes a main suction opening formed therein, which can extend substantially across the width of the nozzle at the front end thereof. The main suction opening is in fluid communication with the vacuum upright body section 402 through a passage and a connector hose assembly. A plurality of wheels 408 support the nozzle on the surface being cleaned and facilitate its movement.

The upright vacuum cleaner 400 includes a vacuum or suction source 409 for generating the required suction airflow for cleaning operations. A suitable suction source, such as an electric motor and fan assembly, generates a suction force in a suction inlet and an exhaust force in an exhaust outlet. Optionally, a filter assembly can be provided for filtering the exhaust air stream of any contaminants which may have been picked up in the motor assembly immediately prior to its discharge into the atmosphere. The motor assembly suction inlet, on the other hand, is in fluid communication with a dust and dirt separating region of the vacuum cleaner 400 to generate a suction force therein.

The dust and dirt separating region housed in the upright section 402 includes a dirt cup or container 410 which is releasably connected to the upper housing 402 of the vacuum cleaner 400. Cyclonic action in the dust and dirt separating region removes a substantial portion of the entrained dust and dirt from the suction airstream and causes the dust and dirt to be deposited in the dirt container 410. The suction airstream enters an air manifold 412 of the dirt container through a suction airstream inlet section which is formed in the air manifold. The suction airstream inlet is in fluid communication with a suction airstream hose through a fitting, for example. The dirt container 410 can be mounted to the vacuum cleaner upright section 402 via conventional means.

The dirt container 410 includes first and second generally cylindrical sections 414 and 416. Each cylindrical sections includes a longitudinal axis, the longitudinal axis of the first cylindrical section 414 is spaced from the longitudinal axis of the second cylindrical section 416. The first and second cylindrical sections 414 and 416 define a first cyclonic airflow chamber and a second cyclonic airflow chamber, respectively. The first and second airflow chambers are each approximately vertically oriented and are arranged in a parallel relationship. The cylindrical sections 414 and 416 have a common outer wall and are separated from each other by a dividing wall. The first and second cyclonic airflow chambers include respective first and second cyclone assemblies. The first and second cyclone assemblies act simultaneously to remove coarse dust from the airstream. The air manifold 412 collects a flow of cleaned air from both of the airflow chambers and merges the flow of cleaned air into a single cleaned air outlet passage or conduit 418 which is in fluid communication with an inlet of the electric motor and fan assembly. The outlet passage 418 has a longitudinal axis which is oriented approximately parallel to the longitudinal axes of the first and second cyclonic chambers.

The mounting tube 300 shown in FIG. 12 can be secured to the nozzle base 404. The sensor 312 can be used to control the operation of a motor (not visible) that powers a brushroll (not visible) mounted in the nozzle base. Also, the sensor 312 can be used to control the operation of the suction source 409, i.e., the amount of suction being drawn, depending on the type of floor surface being cleaned. For example, less suction may be employed on a bare floor and more suction used on a carpeted floor. Also, the brushroll can be powered only when the floor nozzle is on a carpeted floor. When a bare floor is encountered, the motor powering the brushroll can be shut off. Moreover, the wheels 408 can be selectively powered by a drive motor (not shown) to propel the vacuum cleaner 400 over a surface. The output of the sensor 312 can be used, if desired, to control the operation of the drive motor. If desired, the mounting tube 300 can be positioned adjacent a front face of the nozzle base.

Figure 14:
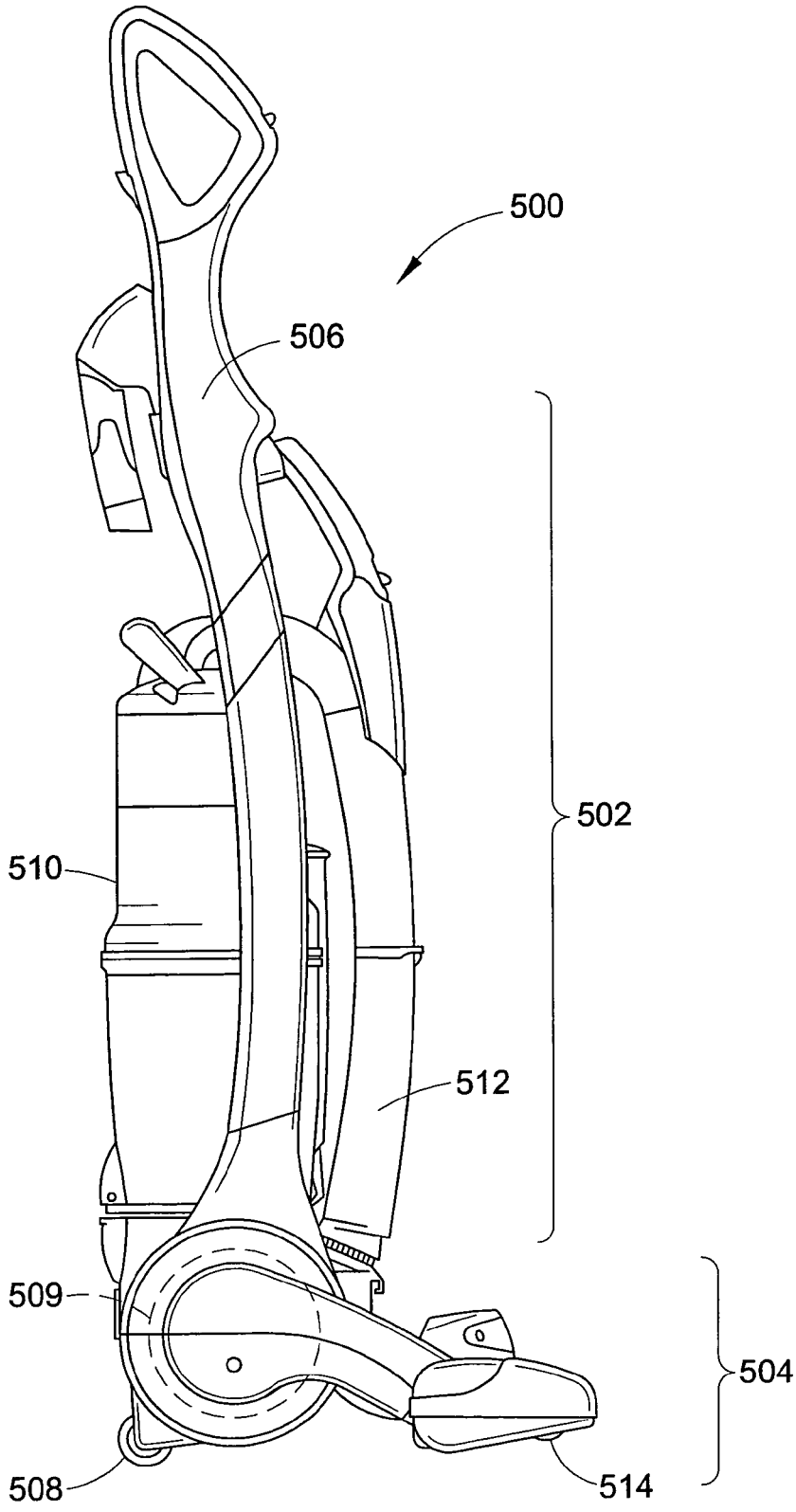
FIG. 14 is a view of an upright vacuum cleaner according to a fourth embodiment of the invention.

With reference to FIG. 14, another upright vacuum cleaner 500 is illustrated. Similarly, the vacuum cleaner 500 includes an upright housing section 502 and a nozzle base section 504, wherein the sections 502 and 504 are pivotally or hingedly connected so that the upright housing section 502 pivots between a generally vertical storage position (as shown) and an inclined use position. The upright section 502 includes a handle 506 extending upward therefrom, by which an operator of the vacuum cleaner 500 is able to grasp and maneuver the vacuum cleaner 500.

During vacuuming operations, the nozzle base 504 travels across a floor, carpet, or other subjacent surface being cleaned. An underside of the nozzle base includes a main suction opening formed therein, which can extend substantially across the width of the nozzle at the front end thereof. The main suction opening is in fluid communication with the vacuum upright body section 502 through a conduit 512. One or more wheels 508 supports the nozzle on the surface being cleaned and facilitate its movement thereacross.

The upright vacuum cleaner 500 includes a vacuum or suction source 509, such as a motor/fan assembly for generating the required suction airflow for cleaning operations. A dust cup 510 is connected by a conduit 5112 to the nozzle base 504. Optionally, a filter assembly (not shown) can be provided for filtering the exhaust air stream from the dust cup 510.

As in the previous embodiment, the mounting tube 300 can be secured to the nozzle base 504. The sensor 312 can be used to control the operation of the suction source 509 or a motor (not shown) which selectively powers a brushroll 514.

Figure 15:
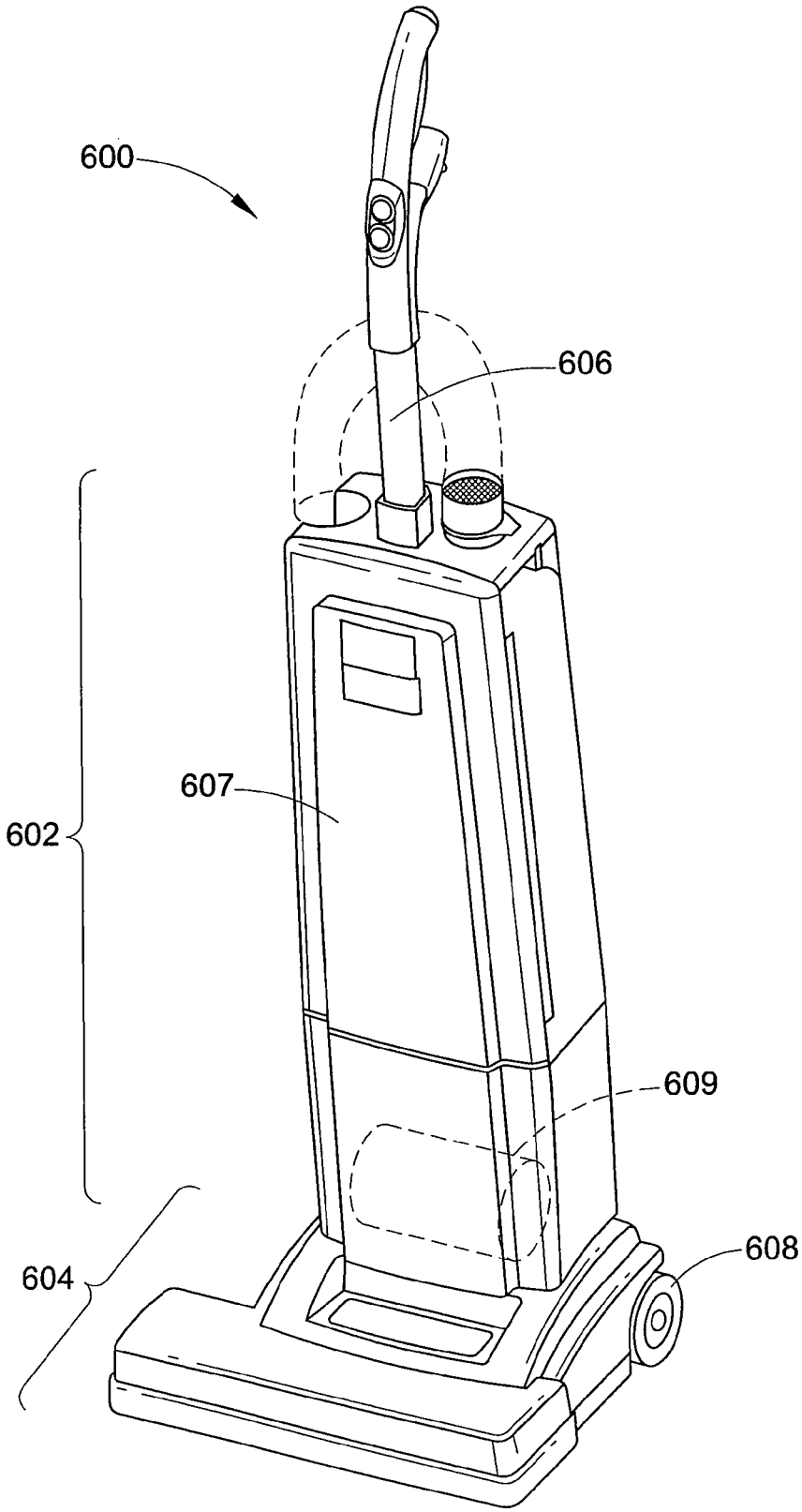
FIG. 15 is a view of an upright vacuum cleaner according to a fifth embodiment of the invention.

With reference to FIG. 15, a hard-shell bag-type upright bag-based vacuum cleaner 600 is illustrated. The vacuum cleaner 600 includes an upright housing section 602 and a nozzle base section 604 in which the sections 602 and 604 are pivotally or hingedly connected so that the upright housing section 602 pivots between a generally vertical storage position (as shown) and an inclined use position. Both the upright and nozzle sections 602 and 604 can be made from conventional materials, such as molded plastics and the like. The upright section 602 includes a handle 606 extending upward therefrom, by which an operator of the vacuum cleaner 600 is able to grasp and maneuver the vacuum cleaner 600. A door 607 is selectively removable from the housing section 602 to exposes a filtration chamber that accommodates a filter bag (not visible).

During vacuuming operations, the nozzle base 604 travels across a floor, carpet, or other subjacent surface being cleaned. An underside of the nozzle base includes a main suction opening formed therein, which can extend substantially across the width of the nozzle at the front end thereof. The main suction opening is in fluid communication with the vacuum upright body section 602 through a passage. One or more wheels 608 supports the nozzle on the surface being cleaned and facilitate its movement thereacross.

The upright vacuum cleaner 600 includes a vacuum or suction source such as an electric motor and fan assembly 609, which generates a suction force for cleaning operations. As in the previous embodiments, the sensor 312 can be mounted to the nozzle based 604, via the mounting tube 300. The sensor 312 can control the operation of a brushroll motor (not visible) and the suction source 609.

Figure 16:
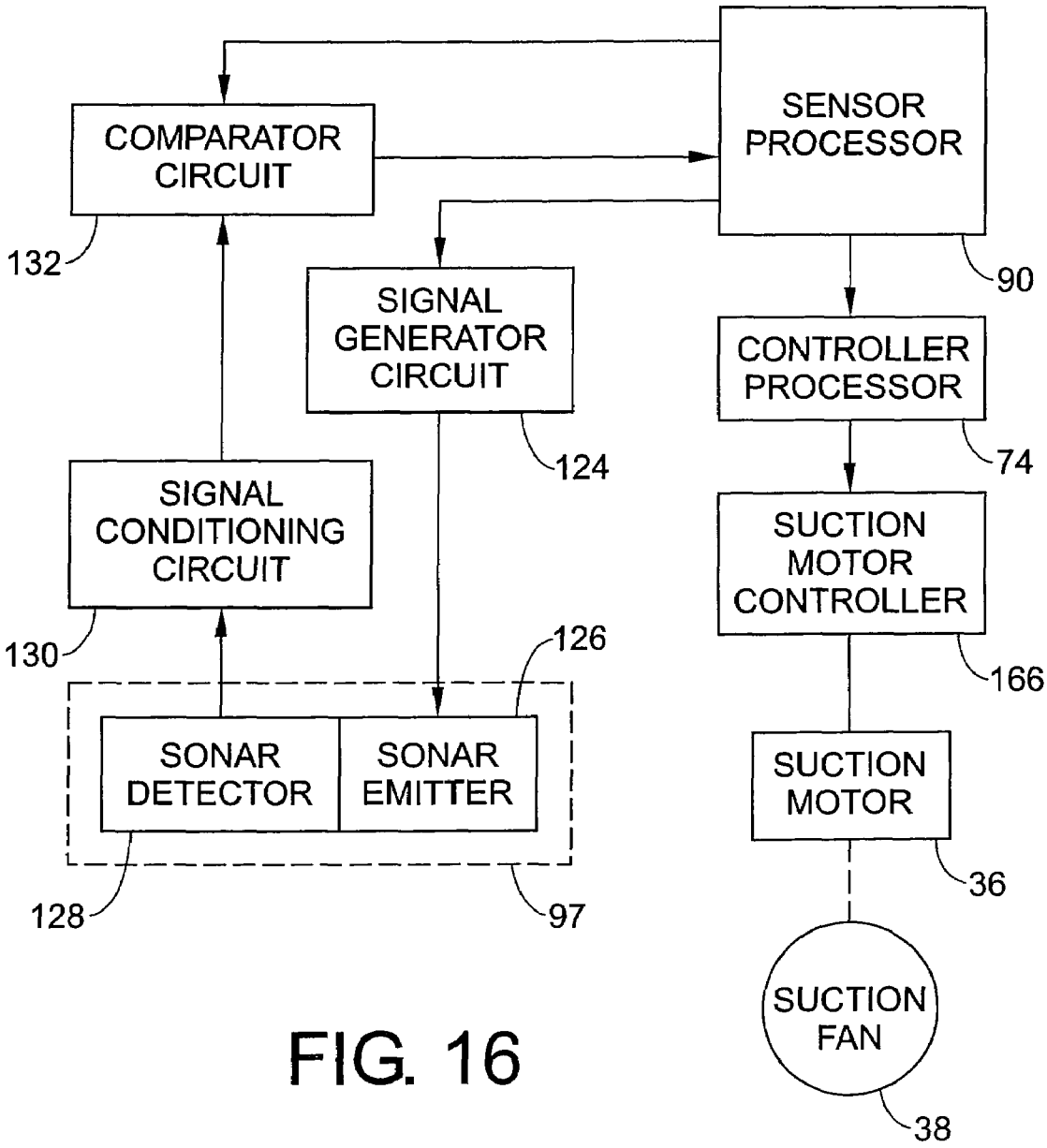
FIG. 16 is a functional block diagram of an embodiment of a cleaning appliance circuit including a sonar sensor according to an embodiment of the invention.

With reference to FIG. 16, a vacuum cleaner circuit with the floor type sensor 97 includes a suction fan 38, the controller processor 74, the sensor processor 90, a suction motor 36, a suction motor controller 166, the signal generator circuit 124, the signal conditioning circuit 130, and the comparator circuit 132. In one embodiment, the floor type sensor 97 is based on sonar technology and includes the sonar emitter 126 and the sonar detector 128. The sonar emitter 126 and the sonar detector 128 can be used in connection with the mounting tube 300 as described in connection with FIG. 12 above.

The sensor processor 90 can communicate a control signal to the signal generator circuit 124. In turn, the signal generator circuit 124 can provide a drive signal to the sonar emitter 126. The control and drive signals may, for example, be about 220 kHz. Normally, the drive signal would be a high voltage stimulus that causes the sonar emitter 126 to emit sonic energy in the direction of the floor to be sensed. Such energy is either reflected (in the case of a hard floor) or partially absorbed and scattered (in the case of a soft or carpeted floor). The reflected sonic energy is received by the sonar detector 128 and converted to an electrical signal, indicative of signal amplitude and/or echo width, for example, and provided to the signal conditioning circuit 130.

The signal conditioning circuit 130 conditions and filters the detected signal so that it is compatible with the comparator circuit 132. If desired, the comparator circuit 132 can be programmable and can receive a second input from the sensor processor 90. The input from the sensor processor 90 can act as a threshold for comparison to the detected signal. One or more predetermined threshold values may be stored in the sensor processor 90 and individually provided to the comparator circuit 132. The output of the comparator circuit 132 can be monitored by the sensor processor 90. The comparator circuit 132 may be implemented by hardware or software. For example, in one embodiment the sensor processor 90 may include a look-up table (LUT) and a comparison process may include matching the detected signal to values in the look-up table where values in the look-up table identify thresholds for the detected signal for various types of floor surfaces. For example, hard floor surfaces, such as concrete, laminate, ceramic, and wood, and soft floor surfaces, such as sculptured carpet, low pile carpet, cut pile carpet, and high pile carpet.

The sensor processor 90 identifies the type of floor being traversed by the vacuum cleaner and communicates type of floor information to the controller processor 74. Based on the type of floor information, the controller processor 74 determines whether or not to operate the suction motor 36 and provides a control signal to the suction motor controller 166 to start or stop the suction motor 36. The controller processor 74 may also control the speed of the suction motor 36 via the suction motor controller 166 if variations in suction, based on the type of floor detected, are desirable. The suction motor controller 166, the suction motor 36, and the suction fan 38 operate as described above in relation to FIG. 3. In an alternate embodiment the suction motor controller 166 may not be required and either the controller processor 74 or the sensor processor 90 may directly control the suction motor 36. In still another embodiment, the sensor processor 90 may directly control the suction motor controller 166.

The reflected sonic energy received by the sonar detector 128 can also be utilized to determine other characteristics such as cleaning head height. For example, the sensor processor 90 can compute a time differential between a transmission of the sonic energy by the emitter 126 and reception of a corresponding echo by the detector 128. The sensor processor 90 can be programmed with a LUT or algorithm that is used to map the time differential to a height. The sensor processor 90 can use the height information to facilitate control of the suction motor controller 166, the suction motor 36, and the suction fan 38, and/or filter noise or interfering signals. For filtering, the sensor processor 90 can be programmed with one or more thresholds that define a range of values that are considered to be within a range of valid values. By example, a lower and/or an upper threshold can be used to exclude or discard signals that are too close or too far, based on the measured height, as erroneous signals. In order allow for closer mounting of the sensor 97 to the floor, the signal threshold can be adjusted and/or damping circuitry can be used to damp the transducing components of the sensor 97.

The vacuum cleaner circuit with the floor type sensor which has been described above, may be implemented in a robotic vacuum cleaner, a robotic canister-like vacuum cleaner, a hand vacuum cleaner, a carpet extractor, a canister vacuum cleaner, an upright vacuum cleaner, and similar indoor cleaning appliances (e.g., floor scrubbers) and outdoor cleaning appliances (e.g., street sweepers) that include rotating brushes.

Figure 17:
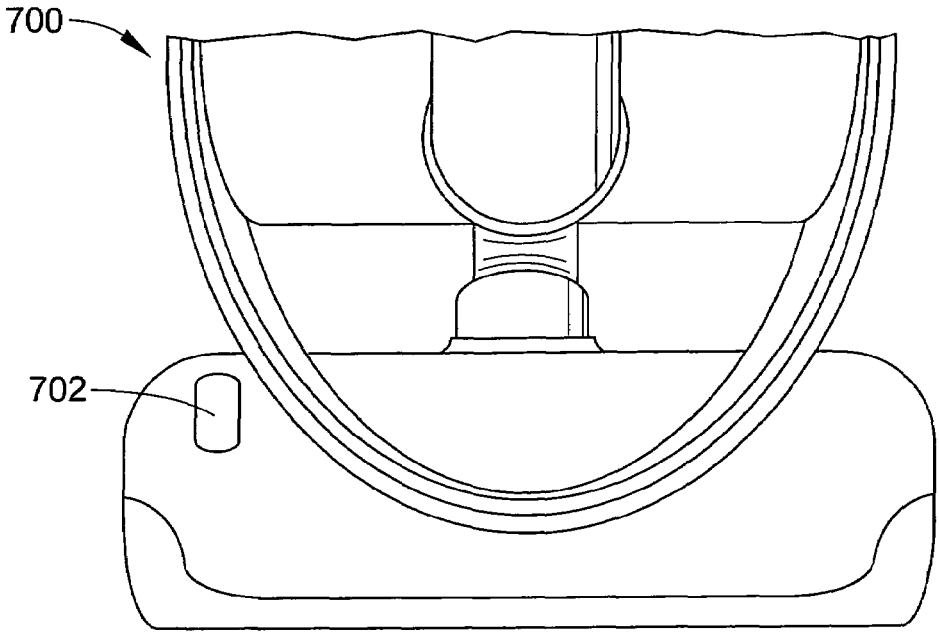
FIG. 17 is a cleaning appliance having an audio activated shut-off feature according to an embodiment of the invention.

With reference to FIG. 17, a cleaning appliance 700 with an audio-activated shut-off device 702 is illustrated. The audio-activated shut-off device 702 is depicted as residing within a base section 704 of the cleaning appliance 700. However, it is to be appreciated that the audio-activated shut-off device 702 can be operatively connected to and/or embedded within essentially any structure of the cleaning appliance, including, but not limited to, a handle section or a body section of the cleaning appliance, or an associated remote control, etc.

The audio-activated shut-off device 702 can include visual indicia identifying the audio-activated shut-off device 702 and/or indicating activation/deactivation of the audio-activated shut-off device 702. In other instances, the audio-activated shut-off device 702 can be embedded within the cleaning appliance without any exterior indication of its existence and/or state. Optionally, the audio-activated shut-off device 702 can include an audio mechanism that identifies presence of the audio-activated shut-off device 702 and/or indicates activation/deactivation of the audio-activated shut-off device 702.

The componentry, associated with the audio-activated shut-off device 702 includes at least a receiver (as described in detail in connection with FIG. 20 below) for receiving one or more signals from an associated transmitter. The associated transmitter can be incorporated into an associated telephone and/or reside in a device separate from the telephone and operatively connected to the telephone or adapted to remotely cooperate with the telephone. The associated transmitter may include telephone ringing detection circuitry to detect when the telephone rings. Additionally or alternatively, a signal (e.g., the telephone signal itself) generated when the telephone rings (e.g., by the telephone or associated supporting componentry) may be used to invoke the associated transmitter to transmit the signal.

In one embodiment, the associated telephone system employs caller ID or the like to obtain a telephone number and/or name associated with a caller. Once determined, the telephone number and/or name of the caller can be compared to a list of pre-programmed numbers and/or names. It is to be appreciated that the list can be stored with the transmitter and/or a component (e.g., memory) residing within the vacuum cleaner. In addition, the comparison can be performed at the transmitter and/or the vacuum cleaner. When performed at the transmitter, it can transmit a shut-off signal along with caller information or a signal indicating the telephone is ringing to the receiver, and/or ignore the ringing telephone.

In one instance, simply locating a matching number or name can invoke removing power from the vacuum as well as other functions. In another instance, the user can set a flag or other indicia for each number and/or name within the pre-programmed list. The flag or other indicia allows the user to determine whether a particular matched number and/or name has permission to remove power from the vacuum cleaner through the telephone ring shut-off feature. For example, the user can set of flag to allow a telephone from a location the user is going to in order to power down the vacuum cleaner from that location. In this manner, the user can place a call from that location to terminate cleaning. Private or otherwise unidentifiable calls can be ignored.

The telephone system may additionally or alternatively employ ring tone technology that associates one or more ring tones with a caller. Such technology can also be used to facilitate discriminating between callers. Based on the ring tone, the associated transmitter can transmit one or more of a telephone number of the caller, a name of the caller, a ring-tone identifier, a shut-off signal along with caller information, and a signal indicating the telephone is ringing to the receiver, and/or ignore the ringing telephone.

When an associated telephone rings, the transmitter transmits a signal (e.g., RF) which is received by the receiver of the audio-activated shut-off device 702. Upon receiving the signal, electrical componentry associated with the audio-activated shut-off device 702 can process the signal and remove power from various components of the cleaning appliance 700. For example, the signal may result in the removal of power from the entire cleaning appliance or one or more components, such as the suction motor 36, the drive motor 104, the brush motor 100, the suction controller 166, the drive controller 148, the brush controller 134, the controller processor 74, etc. In addition, the received signal may elicit one or more audible and/or visual alarms. For example, power from the power distribution component 88 may be supplied to one or more light emitting diodes (LEDs) or other visual component to provide a visual indication that the audio-activated shut-off device 702 is activated/deactivated, that operation of the cleaning appliance was terminated via the audio-activated vacuum shut-off device 702, that the telephone is ringing, etc.

The audio-activated shut-off device 702 can be associated with control circuitry that allows a user of cleaning appliance to enable and/or disable such functionality. For example, the circuitry may be associated with a button, a switch, a slide bar, or the like which toggles the audio-activated shut-off device 702 "on" and "off." When activated (or turned "on"), the audio-activated shut-off device 702 behaves in a manner described above when an associated telephone rings. When deactivated (or turned "off"), the audio-activated shut-off device 702 does not remove power from any component based on a ringing telephone.

De-activation of the audio-activated shut-off device 702 may also result in turning off illumination indicators. Power may be provided to similar and/or different LEDs to indicate activation of the audio-activated shut-off device 702, de-activation of the audio-activated shut-off device 702, power removal in response to a ringing telephone, and/or a ringing telephone. The LEDs typically are located such that they can be easily observed. For example, the LEDs may be located on the handle of the cleaning appliance as described next in connection with FIGS. 18 and 19.

Figure 18:
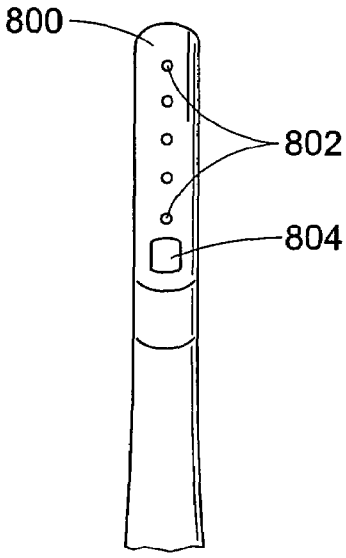
FIGS. 18 and 19 are different views of a handle portion of a cleaning appliance having indicators that visually and/or audibly indicate a state of the cleaning appliance according to an embodiment of the invention.
Figure 19:
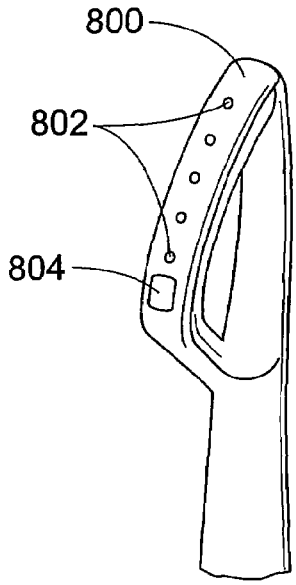

With reference to FIGS. 18 and 19, two views of an exemplary cleaning apparatus handle 800 with LED indicators and/or a sensor on/off mechanism are illustrated. The handle 800 can be adapted to cooperate with essentially any cleaning appliance, including the canister (FIGS. 1-2) and upright (FIGS. 13-15) vacuums described herein.

FIGS. 18 and 19 are depicted with a plurality of LEDs 802. However, it is to be appreciated that more or less LEDs can be utilized in various embodiments, for example, based on the features provided by the cleaning appliance and/or features desired by the user. One or more of the LEDs 802 can be used to indicate, as described above in detail, activation of the audio-activated shut-off device 702, de-activation of the audio-activated shut-off device 702, power removal in response to a ringing telephone, and/or a ringing telephone.

In addition, one or more of the LEDs 802 can be used to indicate activation and/or de-activation of the floor type sensor 97 (e.g., the sonar sensor described in FIGS. 4, 12 and 16). By way of example, the handle 800 can include an activation/deactivation mechanism 804 (e.g., a button, a switch, etc.), electrically connected to the floor type sensor 97 in order to apply and/or remove power to the floor type sensor 97. In one instance, the mechanism 804 may open or close the circuit powering the floor type sensor 97 in order to activate/deactivate the floor type sensor 97. In another instance, the mechanism 804 may invoke a motor controller (e.g., one of the motor controllers 166, 148, and 134), a motor (e.g., one of the motors 36, 104, and 100), the controller processor 74, and/or another component to activate/deactivate the floor type sensor 97. At least one of the LEDs 802 can be used to indicate the state of the floor type sensor 97. For instance, at least one of the LEDs can be illuminated when the floor type sensor is activated and/or deactivated. The activation mechanism 804 may also include components that illuminate depending on whether the mechanism 804 is activated or deactivated.

It is to be appreciated that the LEDs 802 as well as other LEDs can also be used to indicate various other states of the cleaning appliance. For example, cleaning appliance states associated with over or under pressure situations, excessive current draw, etc. and/or environmental conditions such as floor type, distance between cleaning nozzle and cleaning surface, etc. can also be indicated through one or more LEDs. Moreover, other types of illuminating devices and/or audible indicators can be used in addition or alternatively to the LEDs 802.

Figure 20:
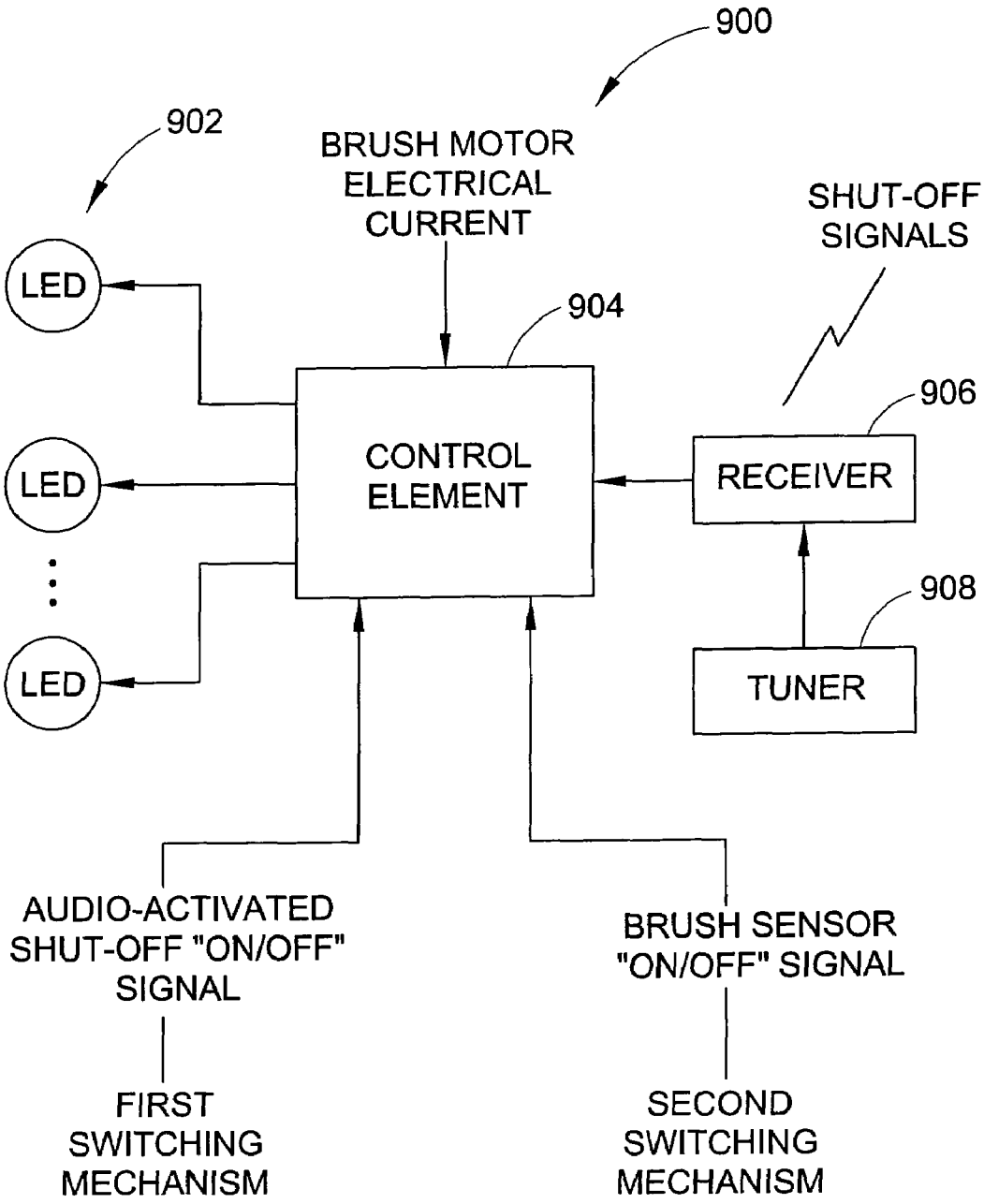
FIG. 20 is an exemplary architecture for controlling visual indicators associated with a cleaning appliance according to an embodiment of the invention.

With reference to FIG. 20, an exemplary architecture 900 for controlling various visual indicators that visual indicate one or more states of a cleaning appliance is illustrated. The visual indicators are depicted as a plurality of LEDs 902; however, other types of visual indicators can be additionally and/or alternatively employed. For example, the visual indicators can include seven segment, liquid crystal, flat screen, etc. displays.

The architecture 900 includes a control element 904 that receives input from an associated first switching mechanism that activates/deactivates the audio-activated shut-off device 702 and/or an associated second switching mechanism that activates/deactivates a brush motor over-current sensor 98. The input from the first and the second switching mechanisms indicates whether the corresponding device 702 and/or sensor 98 is activated or deactivated.

When the first switching mechanism is used to activate the audio-activated shut-off device 702, the control element 904 powers one or more of the LEDs 902, which provides a visual indication that the audio-activated shut-off device 702 is "on," or enabled. If the first switching mechanism is subsequently used to deactivate the audio-activated shut-off device 702, the control element 904 can remove power to the one or more LEDs 902. Alternatively, the one or more LEDs 902 can be illuminated when the audio-activated shut-off device 702 is "off," or disabled, and not illuminated otherwise.

Activating the audio-activated shut-off device 702 activates other circuitry that detects signals transmitted in response to a ringing telephone and/or removes power from one or more components (including removing power from all the components) of the cleaning appliance such as, for example, the suction motor controller 166, the suction motor 36, the suction fan 38, the drive motor controller 148, the drive motor 104, the wheel 50, the brush motor controller 134, the brush motor 100, the brush 54, etc. Such circuitry can reside within the control element 904 or be associated therewith.

A receiver 906 detects and receives one or more signals that indicate a telephone is ringing. It is to be appreciated that the receiver 906 can directly detect a ringing telephone upon receiving signals generated by the ringing, the ringing telephone, and/or detect and receive a signal from an intermediary device (e.g., a transmitter) that detects a ringing telephone, generates a corresponding signal (e.g., RF) that indicates the telephone is ringing, and/or conveys (e.g., broadcasts) such signal to the receiver 906. A tuner 908 is used to tune the receiver 906 to accept signals within a frequency band (band pass) and/or reject signal outside of the frequency band. Such discrimination can facilitate filtering extraneous signals that may erroneously lead to removal of power to one or more components of the cleaning appliance when a telephone is not ringing.

Upon detecting and receiving a signal indicating a telephone is ringing, the receiver 906 notifies the control element 904. If the audio-activate shut-off feature is enabled, the control component 904 removes power from the one or more components of the cleaning appliance. It is to be appreciated that the control component 904 can be programmed to use a default or user customized profile that identifies which components power should be removed from upon receiving such signal. In addition, the control component 904 can illuminate one or more of the LEDs 902 in order to indicate that power was removed from at least one component in response to a ringing telephone and/or a telephone is ringing. The one or more LEDs 902 can be driven to produce a continuous or a periodic illumination (e.g., a flashing LED).

Deactivating the audio-activated shut-off device 702 may result in removal of power from the one or more illuminated LEDs 902 in order to indicate the audio-activated shut-off device 702 has been deactivated. The one or more LEDs 902 that were illuminated can remain illuminated to continue to indicate such events occurred or be reset to a non illuminated state. For instance, power from the one or more LEDs 902 may removed to indicate the audio-activated shut-off device 702 has been deactivated, but one or more other LEDs 902 may continue to be illuminated to indicate that the reason the cleaning appliance shut down was due to a ringing telephone and/or to provide an indication that someone called. In other instances, power is removed from substantially all of the LEDs 902 that were illuminated in response to associated events.

Deactivating the audio-activated shut-off device 702 terminates the ringing telephone auto shut-off feature. However, the control element 904, the receiver 906, and/or the tuner 908 can remain active in order in order detect when a telephone is ringing and, optionally, illuminate one or more of the LEDs 902 to indicate the telephone is ringing. In other instances, deactivating the audio-activated shut-off device 702 also removes power from the receiver 906 and the tuner 908.

It is to be appreciated that the audio-activated shut-off device 702 can also be used to turn "on" one or more components of the cleaning appliance in response to detecting a ringing telephone. For example, the audio-activated shut-off device 702 along with the receiver 906 and the tuner 908 can be enabled, but the cleaning appliance can be left in a non-cleaning state. When a telephone rings, the receiver 904 can receive the signal indicative of the ringing telephone and notify the control element 904, which can invoke circuitry that activates various components associated with cleaning a particular area. Such feature can be used to commence a cleaning job and/or resume a cleaning job that was terminated due to ringing telephone. In addition, ring tone technology that associates one or more ring tones with a caller can be used to discriminate amongst ring tones that activate the audio-activated shut-off device 702; deactivate the audio-activated shut-off device 702; invoke power removal from one or more components of the cleaning appliance; commence a cleaning job; resume a cleaning job; terminate a cleaning job; and do not have an effect on the cleaning appliances (with the exception that one or more of the LEDs 902 can be illuminated to indicate the phone is ringing).

The second switching mechanism activates/deactivates the brush motor over-current sensor 98. Likewise, when the second switching mechanism is used to activate the brush sensor 98, the control element 904 is notified (e.g., via a signal) and powers one or more of the LEDs 902, which provides a visual indication that the brush sensor 98 is "on," or enabled. If the second switching mechanism is used to deactivate the brush sensor 98, the control element 904 removes power from the one or more illuminated LEDs 902. Alternatively, the one or more LEDs 902 can be illuminated when the brush sensor 98 is turned "off," or disabled, and not illuminated otherwise.

When the brush sensor 98 is activated, electrical current draw of the brush motor 100 is monitored by the control element 904. In one instance, the control element 904 includes a comparator that compares the electrical current draw of the brush motor 100 to a predefined range of acceptable operational values. If the current drawn by the brush motor 100 is outside of the predefined range, the control element 904 can remove power from the brush motor 100 and/or components powering and/or controlling the brush motor 100 as described herein.

In addition, the control element 904 can power one or more of the LEDs 902 to indicate power has been removed from the brush motor 100 due to excessive current draw. By way of example, a throw rug may jam an associated brush roll during cleaning. Typically, the jam leads the brush motor 100 to draw more current in order to try to overcome the force preventing the brush motor from turning. The additional current draw can be monitored and used to shut-off the brush motor when it is outside of the predefined range and/or illuminate (e.g., continuously and periodically) one or more of the LEDs 902 to indicate an excessive current draw condition. The foregoing can extend brush roll motor life by mitigating motor burn-out.

When the brush sensor is deactivated, the control element 904 can still monitor brush motor electrical current draw. However, when the electrical current draw is determined to be outside of the predetermined operation range, the control element 904 does not remove power from the brush motor. If desired, the user can configure the control element 904 to continue illuminating the one or more LEDs 902 when an excessive current draw event occurs.

It is to be appreciated that illuminated LEDs 902 (due to an event associated with the audio-activated shut-off device 702 and/or the brush motor over-current sensor 98) can be automatically re-set to a non illumination state when the illumination invoking event ceases and/or manually by cycling cleaning appliance system power. In addition, a user can override any event the results in removal of power from any of the components of the cleaning appliance. Moreover, audio indicators can be additionally and/or alternatively employed.

While the invention is described herein in conjunction with several exemplary embodiments, it is evident that many alternatives, modifications, and variations will be apparent to those skilled in the art. Accordingly, the embodiments of the invention in the preceding description are intended to be illustrative, rather than limiting, of the spirit and scope of the invention. More specifically, it is intended that the invention embrace all alternatives, modifications, and variations of the exemplary embodiments described herein that fall within the spirit and scope of the appended claims or the equivalents thereof.

What is claimed is:

1. A cleaning appliance, including:

a housing to which is mounted a brushroll and a wheel;

a mounting tube secured to said housing;

a floor type sensor, disposed within said mounting tube, for emitting sonic energy toward a surface being traversed by the cleaning appliance and receiving corresponding sonic energy reflected by the surface;

a comparator, electrically coupled to said sensor, for comparing the received reflected sonic energy to one or more associated predetermined values to determine the type of surface being traversed; and a processor that analyzes the results of the comparison and controls at least one of a suction fan, said wheel and said brushroll, based at least in part on the analysis.

2. The cleaning appliance as set forth in claim 1, wherein the sonic energy is used to determine at least one of a signal amplitude and an echo width, wherein the at least one of the signal amplitude and the echo width is compared by the comparator with the one or more associated predetermined values, and the processor analyzes the results of the comparison and controls at least one of said suction fan, said wheel and said brushroll based at least in part on the analysis.

3. The cleaning appliance as set forth in claim 1, said mounting tube including:

a first end portion that faces the surface being traversed;

an opening of said first end portion that allows an ingress and an egress of sonic energy; and a second end portion, disposed opposite the first end portion, wherein said floor type sensor is operatively coupled proximate to said second end portion.

4. The cleaning appliance as set forth in claim 3, said floor type sensor including:

an emitter that emits sonic energy that traverses from said second end portion to said first end portion and out of an opening in said first end portion to the surface being traversed by the cleaning appliance, and a detector that receives sonic energy reflected from the surface that re-enters said opening and traverses from said first end portion to said second end portion, wherein the received reflected sonic energy is conveyed to said comparator.

5. The cleaning appliance as set forth in claim 1, wherein said floor type sensor includes an emitter component and a detector component.

6. The cleaning appliance as set forth in claim 1, wherein said comparator obtains the associated predetermined values from an associated lookup table (LUT) that maps at least one of a signal amplitude and an echo width to a floor type.

7. The cleaning appliance as set forth in claim 1, further including:

a signal generator circuit for generating a signal that invokes transmission of the sonic energy by said floor type sensor; and a signal conditioning circuit for conditioning the received reflected signal prior to the comparison by said comparator.

8. The cleaning appliance as set forth in claim 1, wherein said processor measures a time difference between transmission of the sonic energy from said floor type sensor and reception of the reflected sonic energy by said floor type sensor.

9. The cleaning appliance as set forth in claim 8, wherein said processor compares the measured time difference with values that map time differences to height in order to determine the height of said housing relative the surface being traversed.

10. The cleaning appliance as set forth in claim 1, further including an element that selectively removes power from one or more components of the cleaning appliance when a telephone rings.

11. The cleaning appliance as set forth in claim 10, wherein said element includes at least one of visual indicia and audio indicia that at least one of a) identifies said element and b) indicates whether said element is in an activated or deactivated stage.

12. The cleaning appliance as set forth in claim 10, wherein said element includes:

a receiver, and a transmitter that transmits a signal to said receiver in response to a ringing telephone.

13. The cleaning appliance as set forth in claim 12, wherein the transmitter includes detection circuitry to detect when a telephone rings.

14. The cleaning appliance as set forth in claim 1, further including one or more visual indicators that visually indicate one or more of the following events: an audio-activated cleaning appliance shut-off device is activated; the audio-activated cleaning appliance shut-off device is deactivated; power has been removed from at least one component of the cleaning appliance in response to a ringing telephone; a cleaning job by the cleaning appliance has commenced in response to a ringing telephone; a cleaning job by the cleaning appliance has terminated in response to a ringing telephone; a cleaning job by the cleaning appliance has resumed in response to a ringing telephone; an associated telephone is ringing; and a brush motor over-current condition exists.

15. The cleaning appliance as set forth in claim 1, further including:

a control element that receives a signal indicating an audio-activated cleaning appliance shut-off device is in one of an activated and a deactivated state; and at least one illuminating component that is illuminated by the control element in response to the control element receiving the signal.

16. A vacuum cleaner, comprising:

a housing including:

a suction opening located in a bottom wall of said housing;

a brushroll mounted to said housing and located in said suction opening;

a wheel mounted to said housing for supporting said housing on a subjacent surface; and a mounting tube secured to said housing, said mounting tube including:

a first end, opening to said housing bottom wall; and a second end;

a floor type sensor disposed adjacent to said mounting tube second end for emitting sonic energy toward the subjacent surface and receiving corresponding sonic energy reflected by the surface;

a comparator, electrically coupled to said sensor, for comparing the received reflected sonic energy to one or more associated predetermined values to determine the type of surface being traversed; and a processor that analyzes the results of the comparison and controls at least one of a suction fan, said wheel and said brushroll, based at least in part on the analysis.

17. The cleaning appliance as set forth in claim 16, wherein the sonic energy is used to determine at least one of a signal amplitude and an echo width, wherein the at least one of the signal amplitude and the echo width is compared by the comparator with the one or more associated predetermined values, and the processor analyzes the results of the comparison and controls at least one of said suction fan, said wheel and said brushroll based at least in part on the analysis.

18. The cleaning appliance as set forth in claim 16, said floor type sensor includes an emitter component and a detector component.

19. The cleaning appliance as set forth in claim 16, further including:

a signal generator circuit for generating a signal that invokes transmission of the sonic energy by said floor type sensor; and a signal conditioning circuit for conditioning the received reflected signal prior to the comparison by said comparator.

20. A vacuum cleaner, comprising:

a floor nozzle including:

a suction opening communicating with a suction source;

a brushroll;

a first motor for driving said brushroll;

at least one wheel on which said floor nozzle is mounted to allow the floor nozzle to move in relation to a subjacent surface;

a second motor for driving said at least one wheel; and a mounting tube including a first end, opening toward the subjacent surface, and a second end;

a sonic sensor disposed adjacent to said mounting tube second end for emitting sonic energy toward the subjacent surface and receiving corresponding sonic energy reflected by the surface;

a comparator, electrically coupled to said sensor, for comparing the received reflected sonic energy to one or more associated predetermined values to determine the type of surface being traversed; and a processor that analyzes the results of the comparison and controls at least one of said suction source, said first motor, and said second motor.

21. The cleaning appliance as set forth in claim 20, wherein the sonic energy is used to determine at least one of a signal amplitude and an echo width, wherein the at least one of the signal amplitude and the echo width is compared by the comparator with the one or more associated predetermined values, and the processor analyzes the results of the comparison and controls at least one of said suction source, said first motor and said second motor based at least in part on the analysis.

22. The cleaning appliance as set forth in claim 20, said floor type sensor includes and emitter component and a detector component.

23. The cleaning appliance as set forth in claim 20, further including:

a signal generator circuit for generating a signal that invokes transmission of the sonic energy by said floor type sensor; and a signal conditioning circuit for conditioning the received reflected signal prior to the comparison by said comparator.

24. The cleaning appliance as set forth in claim 20, wherein a speed of at least one of said brushroll, said wheel, and said suction source is dynamically changed based on at least one of the type of surface and a characteristic of the surface being traversed.

* * * * *